US011274889B2

(12) United States Patent
Hubbell et al.

(10) Patent No.: US 11,274,889 B2
(45) Date of Patent: Mar. 15, 2022

(54) AMBIDEXTROUS CHARGING HANDLE

(71) Applicant: Sig Sauer, Inc., Newington, NH (US)

(72) Inventors: Reed Hubbell, Newmarket, NH (US); David B. Hopkins, Exeter, NH (US); Harry Andrew Packard, Amesbury, MA (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/777,071

(22) Filed: Jan. 30, 2020

(65) Prior Publication Data

US 2020/0292258 A1 Sep. 17, 2020

Related U.S. Application Data

(60) Provisional application No. 62/798,772, filed on Jan. 30, 2019.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72
See application file for complete search history.

(56) References Cited

U.S. PATENT DOCUMENTS

| | | | | |
|---|---|---|---|---|
| 3,225,653 | A * | 12/1965 | Packard | F41A 3/72 89/1.4 |
| 7,707,921 | B1 * | 5/2010 | Hoel | F41A 3/20 89/1.4 |
| 9,683,795 | B1 * | 6/2017 | Novak | F41A 35/06 |
| 9,964,371 | B1 * | 5/2018 | Huang | F41A 35/06 |
| 2016/0356564 | A1 * | 12/2016 | Curry | F41A 3/72 |
| 2018/0010868 | A1 * | 1/2018 | Bailey | F41A 5/26 |

OTHER PUBLICATIONS

Johnson, Richard, Guns Holsters and Gear, "Expanse M4: Colt's Cheap AR" (Jan. 7, 2016) (accessed online May 31, 2021).

* cited by examiner

*Primary Examiner* — Gabriel J. Klein
(74) *Attorney, Agent, or Firm* — Finch & Maloney PLLC

(57) ABSTRACT

A charging handle assembly includes a body extending along a longitudinal axis and having a proximal end portion and a distal end portion. A handle is connected to the proximal end portion of the body and is translatable along the body between a first position and a second position. A latch is connected to the handle or the body and is operable between a latched position and an unlatched position. Moving the handle from the first position to the second position moves the latch from the latched position to the unlatched position. Also disclosed is a charging handle assembly with a latch configured to engage a top of the lower receiver.

21 Claims, 18 Drawing Sheets

AMBIDEXTROUS CHARGING HANDLE

RELATED APPLICATIONS

This application claims priority under 35 U.S.C. § 119(e) to U.S. Provisional Patent Application No. 62/798,772 titled AMBIDEXTROUS CHARGING HANDLE and filed on Jan. 30, 2019, the contents of which are incorporated herein by reference in its entirety.

FIELD OF THE DISCLOSURE

The present disclosure generally relates to firearms and firearm accessories. Specifically, the present disclosure is directed to a charging handle for firearms.

BACKGROUND

A charging handle is a device on a firearm which serves multiple functions. The charging handle can be used to manually cycle the action, eject a cartridge or spent casing from the firing chamber of a firearm, resolve interruptions to the supply of ammunition to the firing chamber (e.g., a stoppage, double feed, stovepipe, or misfire), verify that the chamber is clear of any obstructions, and load a round into the chamber from an ammunition magazine. The charging handle also moves components of the fire control group to the ready position in preparation for firing a chambered round.

SUMMARY

The present disclosure is directed to a charging handle for firearms. In accordance with some embodiments, a charging handle assembly includes a body extending along a longitudinal axis and having a proximal end portion and a distal end portion. A handle is connected to the proximal end portion of the body and is translatable along the body between a first position and a second position. A latch is connected to the handle or the body and is operable between a latched position and an unlatched position. Moving the handle from the first position to the second position moves the latch from the latched position to the unlatched position. A spring biases the handle and latch towards the latched position, and upon release of the handle, the latch can return to the latched position. The handle functions as the actuator for the latch, and therefore enables ambidextrous operation of the charging handle.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
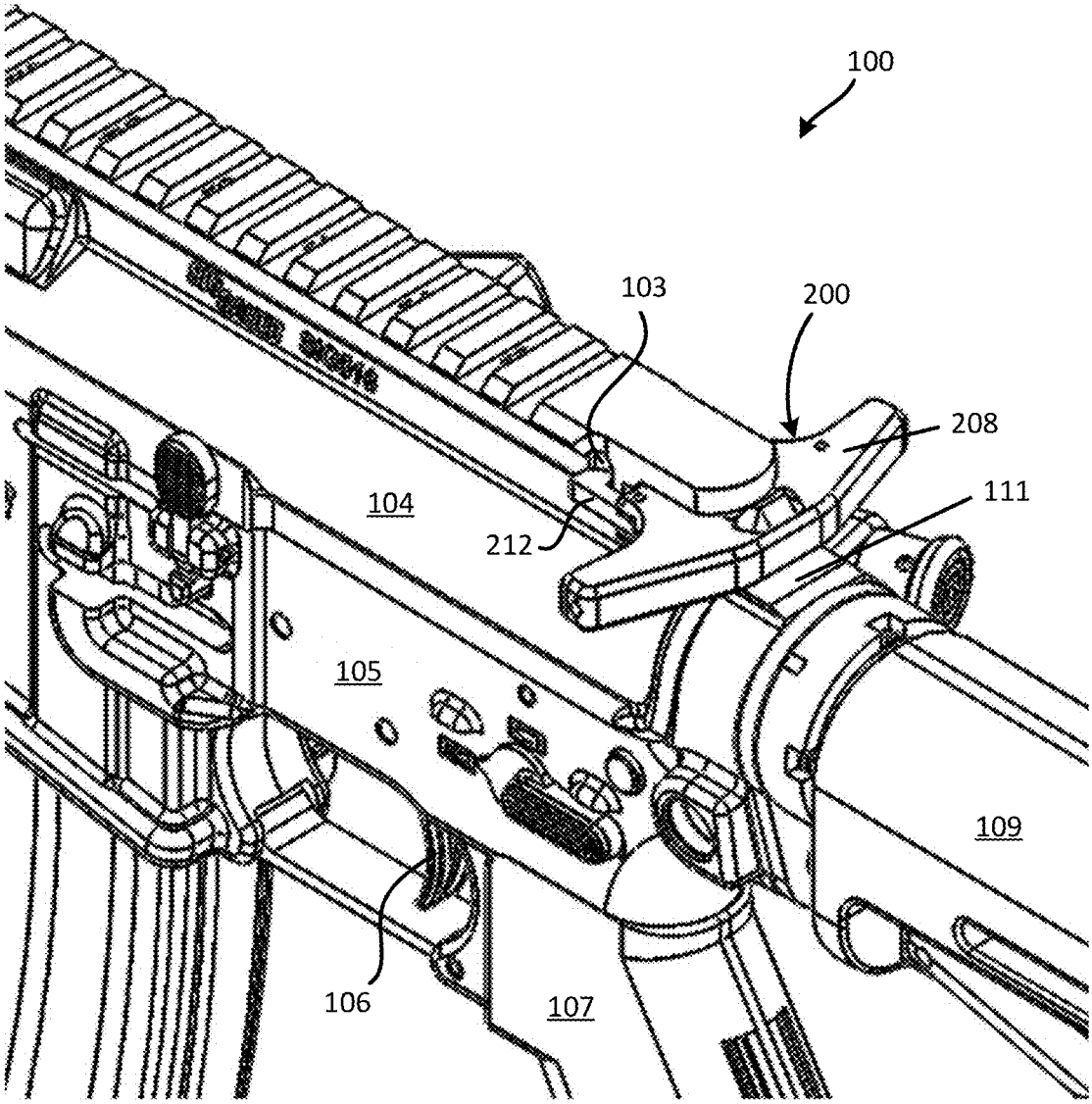
FIG. 1 is a top and rear perspective view of a portion of a firearm with a charging handle assembly, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a charging handle assembly for a firearm, where pulling back on the handle moves the latch or latches from a latched position to an unlatched position, in accordance with some embodiments. Since the handle functions as the latch actuator, charging handle assemblies as variously described herein can be operated from a left-hand side or a right-hand side of the firearm, in accordance with some embodiments. In one example, the charging handle assembly has a single latch positioned on one of the lateral sides of the elongated body and configured to engage a side of the firearm upper receiver. In another example, a pair of latches may be positioned on opposite lateral sides of the body. In yet another example, a latch may be positioned on an underside of the body to engage other structural elements of the firearm, such as the top of the lower receiver.

The latch or latches can be moved between a latched position and an unlatched position by pulling the handle rearward with respect to the elongated body of the charging handle assembly. Movement between the latched and unlatched positions can be by pivoting the latch or translating the latch, for example. In one example, a cross pin extends through an elongated opening that is oriented perpendicular to the body. The elongated opening can allow forward and rearward movement of the cross pin and handle relative to the body during actuation of the charging handle assembly. Relative movement between the handle and the elongated body causes the latch(es) to move between the latched and unlatched positions, such as by the latch contacting a cam surface on the handle or contacting a cam surface on the body.

As the handle is drawn rearward, for example, the cross pin moves within the elongated opening and engages a protrusion or surface on the latch to pivot the latch to an unlatched position. In one such embodiment, the cross pin engages a protrusion on part of the latch to pivot the latch. In another such embodiment, the cross pin engages a latch on the underside of the body and pivots the latch upward to the unlatched position.

In another example, movement of the handle relative to the body causes a protrusion on the latch to engage a portion of the handle or body to pivot the latch to the unlatched position. In one such embodiment, a protrusion on the latch engages a cam surface on the body. In another such embodiment, the latch has an L-shape and includes a post extending laterally through the body. In the latched position, the free end of the post is received in a recess in the handle. As the handle is drawn rearward, the post is moved out of the recess and the latch displaced laterally by a cam surface to an unlatched position. Numerous variations and embodiments will be apparent in light of the present disclosure.

GENERAL OVERVIEW

Rifles based on the AR-15 platform and similar rifles have a non-reciprocating charging handle assembly that includes an elongated body, a handle secured to the body, and a pivoting latch assembly. In some existing charging handle configurations, the handle is fixed to the body so that it does not move. The latch has an L-shape with a catch portion extending forward along the body and a latch lever extending laterally and outward along the front face of the handle. As the user grasps the charging handle, the latch lever is depressed against the handle, pivoting the latch's catch surface out of engagement with the side of the rifle upper receiver.

Traditionally, the charging handle has been equipped with a single L-shaped latch on the left side of the receiver, such as for actuation by a right-handed operator's support hand (left hand). More recently, charging handles have been developed with latches on both sides of the receiver for actuation by either hand. In some such designs, both the right and left latches include a latch lever. The right and left latches are operatively coupled near the centerline of the handle body so that actuation of one latch also actuates the other latch. In other designs, the handle still uses a single L-shaped latch with a latch lever, but it has been made larger for easier operation. Despite these developments, non-trivial challenges remain. For example, clothing, vegetation, or other debris can sometimes become caught between the latch lever and the handle, rendering the charging handle inoperable until the obstruction is removed. Similarly, dust and debris introduced into the link between the two latches can interfere with latch operation.

The present disclosure addresses these challenges and others by providing a charging handle assembly in which the handle unit functions as the actuator. For example, the handle is attached to the body and can translate forward and rearward along the proximal end portion of the body. In the latched condition, the handle is biased forward by a spring. When the operator pulls back on the handle, the handle moves rearward with respect to the body and in turn the latch moves from the latched position to the unlatched position. Using the handle unit as the actuator, rather than a latch lever, enables a variety of usage methods.

In accordance with some embodiments of the present disclosure, when the handle portion itself is the actuator, the operator can advantageously operate the charging handle without the need to depress a latch lever against the handle. Such functionality can facilitate operating the charging handle, for example, if the operator is injured, wearing gloves, or has limited space to grasp the charging handle. In some embodiments, positioning a latch on one or both sides of the firearm may also enable use of a larger latch release that may enable the firearm operator to use the charging handle assembly with greater ease.

In some embodiments, the position of the latch can reduce or eliminate interference with clothing or debris. In some such embodiments, the latch and springs are protected within the charging handle assembly. For example, the latch and spring are housed in a cavity on the underside of the body. In another example, the proximal end portions of side latches are housed within the handle. Such latch placement can reduce or eliminate entanglement with vegetation and clothing.

As discussed herein, terms referencing direction, such as upward, downward, vertical, horizontal, left, right, front, back, etc., are used for convenience to describe embodiments of a charging handle assembly for a firearm, where the charging handle is oriented with the body extending horizontally and the handle and body defining a horizontal plane. Embodiments of the present disclosure are not limited by these directional references and it is contemplated that a charging handle assembly in accordance with the present disclosure could be used in any orientation.

Also, it should be noted that, while generally referred to herein as a 'charging handle assembly' for consistency and ease of understanding the present disclosure, the disclosed charging handle assembly is not limited to that specific terminology and alternatively can be referred to, for example, simply as a charging handle, a charging assembly, or other terms. Similarly, while generally referred to herein as a 'body' for consistency and ease of understanding the present disclosure, the disclosed charging handle assembly is not limited to that specific terminology and the body alternatively can be referred to, for example, as a shaft or tongue. As will be further appreciated, the particular configuration (e.g., materials, dimensions, etc.) of a charging handle assembly configured as described herein may be varied, for example, depending on whether the intended end-use is military, tactical, or civilian in nature. Numerous variations, configurations, and other embodiments will be apparent in light of the present disclosure.

EXAMPLE EMBODIMENTS

FIG. 1 is a perspective view of a portion of a firearm 100 that is presented to provide context for various ambidextrous charging handle assemblies of the present disclosure. The firearm 100 of FIG. 1 includes a charging handle assembly 200, an upper receiver 104, and a lower receiver 105. Firearm 100 can be an automatic or semiautomatic firearm, and can be configured as a rifle, machine gun, submachine gun, short-barreled rifle, or pistol. While the example shown in FIG. 1 includes an ambidextrous charging handle assembly 200 with a side latch 212, it will be appreciated that the particular configuration shown can be replaced with any of the other embodiments of charging handle assemblies described herein.

The upper receiver 104 is an element of the firearm 100 and houses the bolt carrier group and charging handle assembly 200. The upper receiver 104 also connects to the barrel assembly (not visible). The lower receiver 105 includes the fire control group 106, stock 109, and grip 107. The lower receiver 105 and upper receiver 104 assemble together, such as shown in FIG. 1, to complete a rifle capable of firing. The upper receiver 104 is configured to engage with a latch 212 on the charging handle assembly 200. For example, the upper receiver 104, in some examples, can include a catch recess 103, opening, notch, groove, protrusion, or other feature configured to engage one or more latches 212 of the charging handle assembly 200. As shown in this example, the charging handle assembly 200 is in the latched position with a side latch 112 engaged in the recess 103 in the side of the upper receiver 104. In other embodiments, the latch may be on the bottom of the charging handle assembly 200 and configured to engage the uppermost shelf 111 of the upper receiver, such as described in more detail below.

As with charging assemblies generally, various embodiments of a charging handle assembly 200 of the present disclosure are configured to facilitate ejection of a spent cartridge casing or unfired round, chamber a round from the magazine, and move the bolt-carrier group to a charged position, as explained above. Furthermore, in the embodiments described herein, example charging handle assembly 200 (as well as other charging handle assemblies of the present disclosure) can be configured as an ambidextrous charging handle assembly such that a user can grasp the handle 208 from either side of the firearm 100 to operate the charging handle assembly 200. In particular, since the charging handle assembly 200 is actuated by rearward movement of the handle 208, it need not include a latch lever for each latch 212, and therefore can be configured for ambidextrous use based on the handle 208 having a shape that is accessible from either side of the firearm 100.

In operation, for example, drawing the charging handle assembly 200 rearward can manually cycle the action of the firearm 100 and eject a spent cartridge casing or unfired round from the chamber, such as in the case of cartridge misfire. The charging handle assembly 200 can also be used to chamber a round after installing a loaded magazine into the magazine well, or to draw back the bolt for manually loading a cartridge into the chamber. In addition, movement of the charging handle assembly 200 can be used to verify a chambered round and/or to clear any obstructions in the chamber, such as a jammed cartridge. Given this context, specific embodiments of the present disclosure will now be discussed.

Charging Handle with Side Latch

Figure 2A:
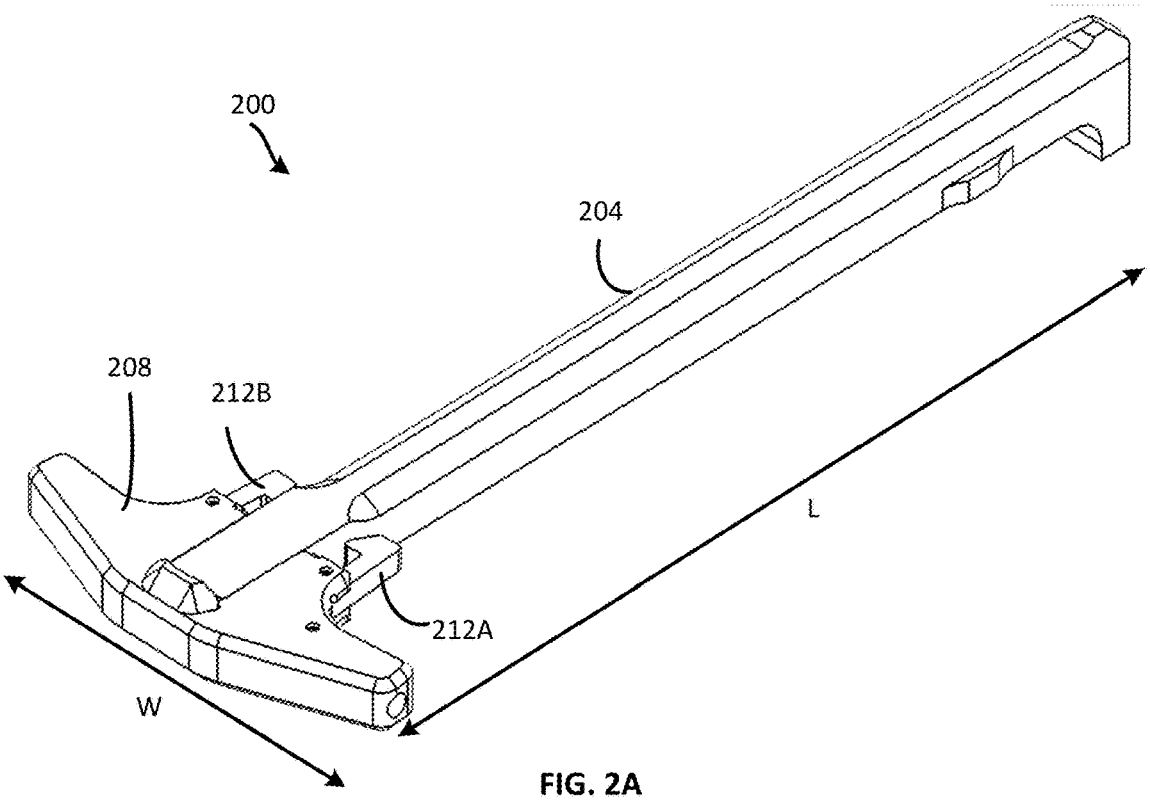
FIG. 2A is a top and rear perspective view of a charging handle assembly configured for use in the firearm shown in FIG. 1, in accordance with an embodiment of the present disclosure.
Figure 2B:
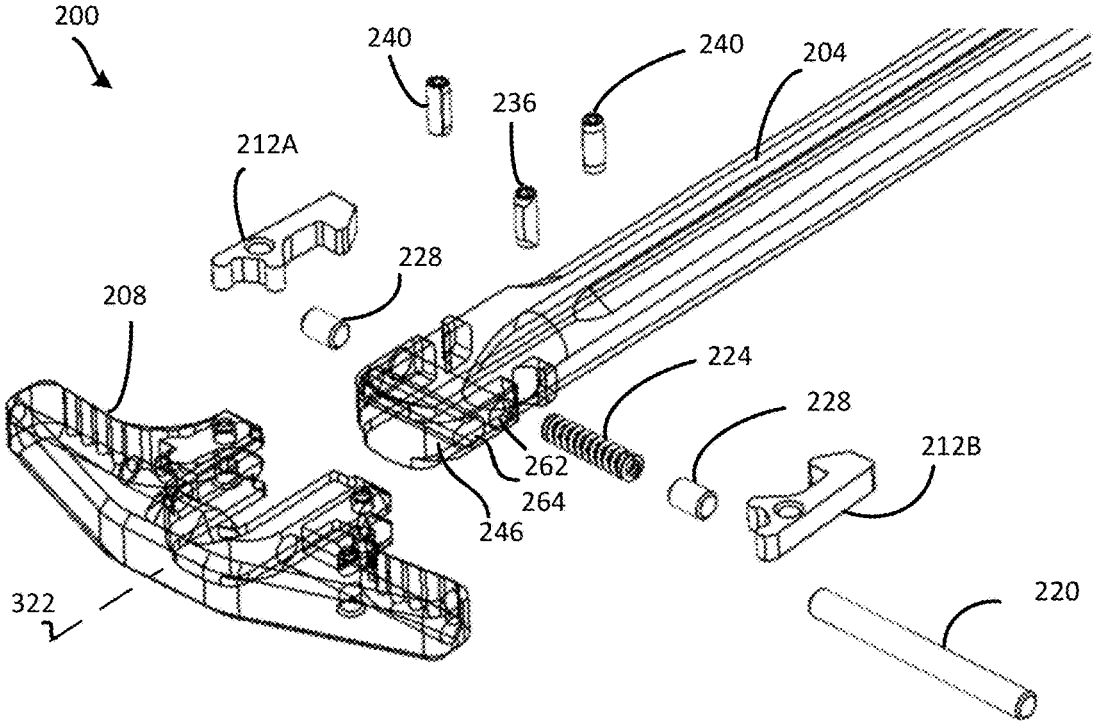
FIG. 2B is an exploded top and rear perspective view of the charging handle assembly shown in FIG. 2A, in accordance with an embodiment of the present disclosure.

FIGS. 2A and 2B illustrate one example of a charging handle assembly 200 of the present disclosure. FIG. 2A is a top and rear perspective view of a charging handle assembly 200 shown, and FIG. 2B is an exploded top and rear perspective view of part of the charging handle assembly 200 shown in FIG. 2A. The charging handle assembly 200 includes a body 204, a handle 208 connected to the body 204, and one or more latches 212 that are actuated by moving the handle 208 rearward with respect to the body 204. The charging handle assembly 200 also includes a cross pin 220, a spring 224, plungers 228 on the spring 224, a handle pin 236, and latch pins 240. The handle 208 has a width "W" and the body 204 has a length "L."

At a high level, the example charging handle assembly 200 shown in these figures can be configured for ambidextrous operation since rearward movement of the handle 208 relative to the body 204 causes the latch(es) 212 to move to the unlatched position. The body 204 extends longitudinally with the handle 208 mounted on the proximal end portion 246. The proximal end portion 246 of the body 204 also defines various lateral channels through which pins and springs can be placed. An elliptical or elongated cross-sectional shape of one of these channels enables a cross pin 220 to shift forward or backward relative to the body 204 in response to the movement of the handle 208. This shift in the cross pin 220 enables the handle 208 to move relative to the body 204 of the charging handle assembly 200, thus actuating one or more side latches 212 so that the entire charging handle assembly 200 can shift. The charging handle 108 is configured to draw a bolt of the firearm 100 rearward to ready the firearm 100 for its next firing cycle, as with other configurations of charging handles generally. As indicated above, shifting or translating the charging handle assembly 200 can move the bolt carrier group rearward to eject a spent cartridge or unfired round. Such movement can also allow for manual loading of a round into the chamber, or other function of the charging handle assembly, as will be appreciated.

In some examples, the body 204 is an elongate structure (with various other features described below) that can be connected to the handle 208 and mounted to a portion of firearm, such as an upper receiver 104. Drawing the handle 208 rearward relative to the body 204 actuates the latch(es) 212, causing each latch 212 to disengage from a catch recess 103 or similar structure on a receiver of a firearm 100 (shown in FIG. 1). In general, the body 204 transmits the force applied to the handle 208 by the user to the bolt of the firearm 100 to draw the bolt rearward. To this end, the body 204 can be manufactured from materials, including carbon steel, stainless steel, aluminum, alloys of these metals, polymers, and composite materials. In addition, the body 204 can be a unitary piece or combination of several pieces, such as a weldment. The body 204 can be manufactured using fabrication processes and techniques, such as machining, welding, and additive manufacturing.

Referring to FIG. 2B, in some examples, the assembly 200 can include a cross pin 220 and a handle pin 236 (e.g., a spring pin). The cross pin 220 can be used to connect the handle 208 to the body 204 and the handle pin 236 can maintain the position of cross pin 220 within the handle. The configuration of the cross pin 220 enables the forward and rearward movement of the cross pin 220 within the slot 264 relative to the body 204 upon actuation of the handle 208. Forward and rearward ward movement of the cross pin 220 facilitates the actuation of the latches 212, in accordance with some embodiments. The cross pin 220 can be received within the slot 264 of the body 204, such that the handle 208 can move relative to the body 204 to operate the latches 212, as will be described in more detail below with reference to FIGS. 5A and 5B. The cross pin 220, in some examples, can be a solid pin having a uniform cross-sectional shape made from materials such as carbon steel, corrosion resistant steel, or aluminum.

In some examples, the assembly 200 can also include a spring 224 that provides a biasing force to the latches 212 (via plungers 228) when compressed. In one example, the spring 224 can be positioned in a spring bore 262 that extends crosswise to the longitudinal axis 322 so that the spring 262 can interface with the latches 212 via the plungers 228. For example, when a user pulls back the handle 208, the spring 224 is compressed by the force exerted by the latches on the spring 224 through the plungers 228. Upon release of the handle 208, the spring 224 expands, causing rotation of the latches 212 towards the body 204. Releasing the handle 208 also allows the handle 208 to move forward so that the handle 208 reseats itself against the body 204, as will be described further in FIGS. 5A and 5B. The spring 224, in some examples, can be a coil spring made from steel or music wire.

In some examples, the assembly 200 can also include plungers 228. In one example, each plunger 228 can be positioned between the spring 224 and the latch 212 on either or both sides of the body 204. The configuration of the plungers 228 enable them to partially move inside the spring bore 262 on both sides of the bore when the spring 224 is compressed. The plungers 228 move outward when the spring 224 expands. The plungers 228, in one example, can be made from materials such as carbon steel, corrosion resistant steel, or aluminum.

In some examples, the assembly 200 can include a latch pin 240 that can pivotally secure each latch 212 to the handle 208. The configuration of the latch pins 240 enables each latch to rotate about the latch pin 240 in a horizontal plane between the latched and unlatched positions.

Figure 2C:
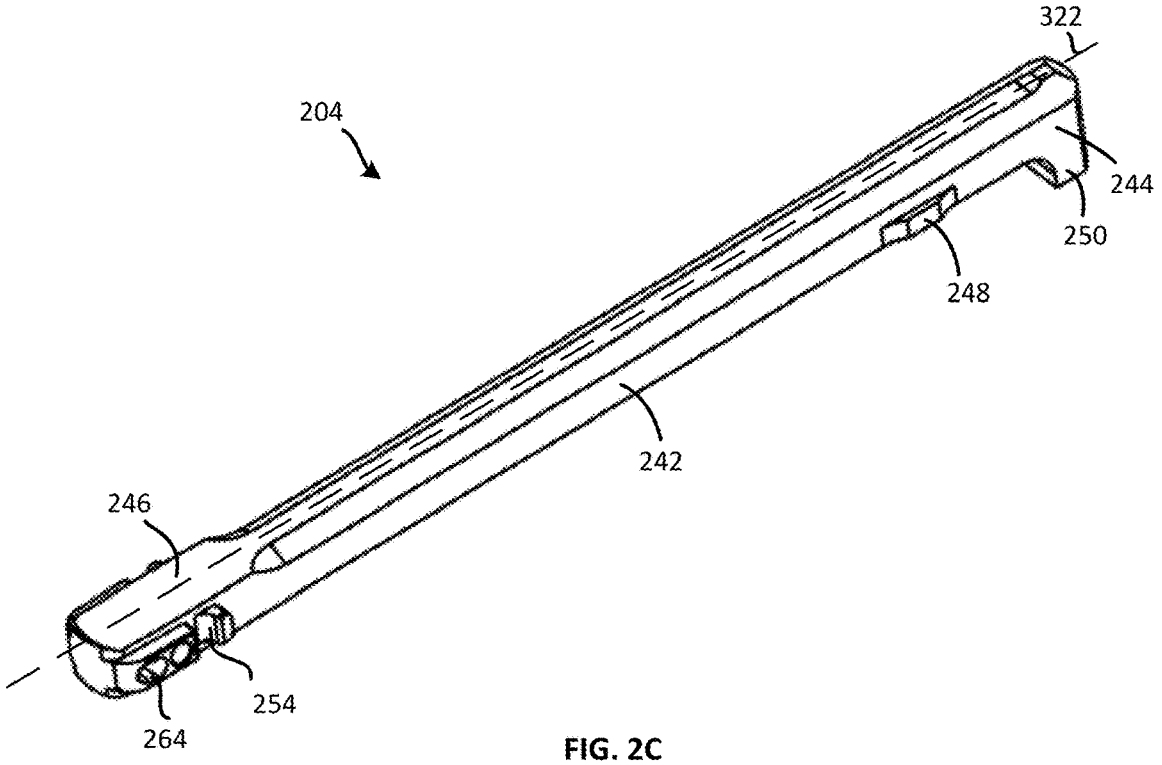
FIG. 2C is a top and rear perspective view of a body of the charging handle assembly shown in FIGS. 2A-2B, in accordance with an embodiment of the present disclosure.
Figure 2D:
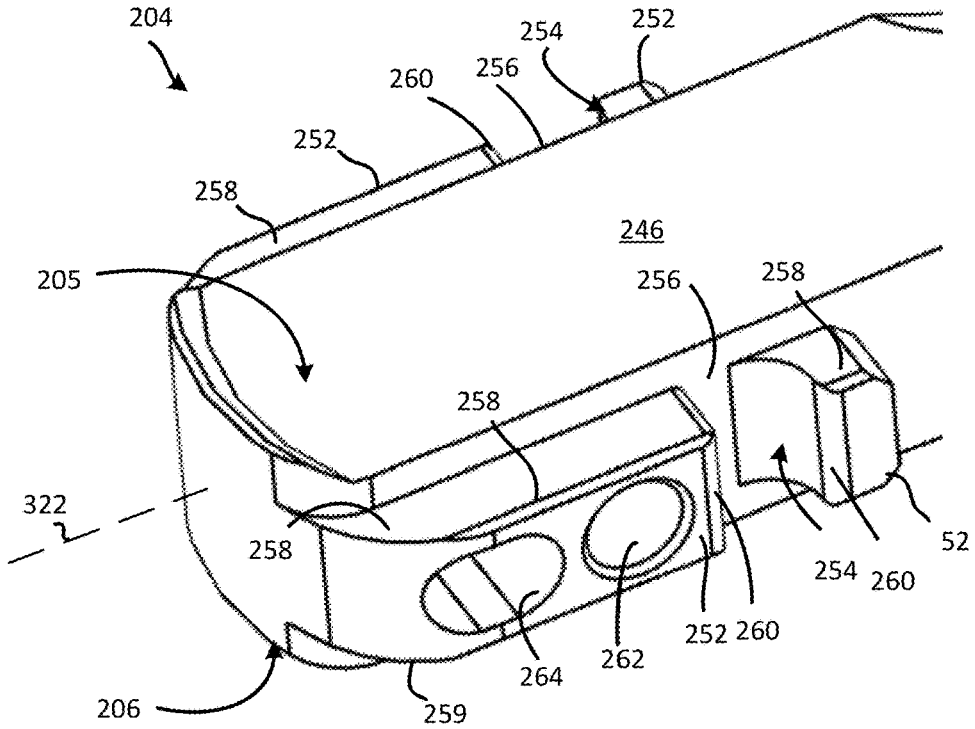
FIG. 2D is an enlarged top and rear perspective view of a proximal end portion of the body shown in FIG. 2C.
Figure 2E:
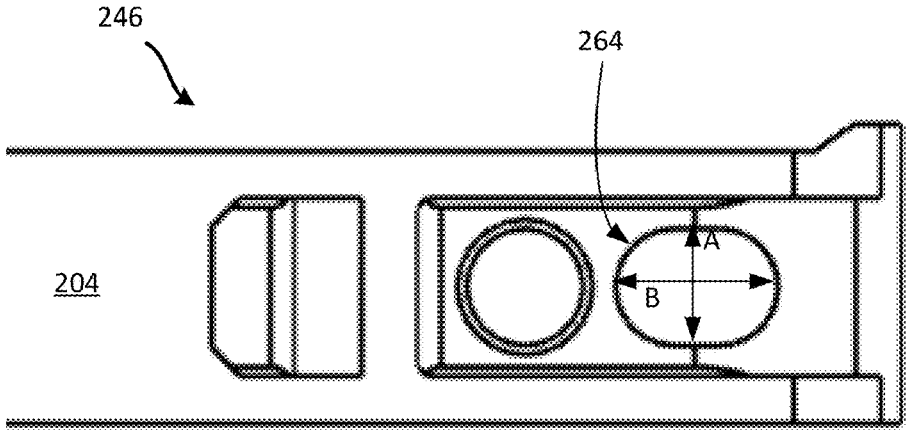
FIG. 2E is view of the left side of a proximal end portion of the body shown in FIG. 2C, in accordance with an embodiment of the present disclosure.

Referring now to FIGS. 2C, 2D and 2E, top, rear perspective, and side views, respectively, illustrate the body 204 and elongated slot 264 in more detail. The body 204 extends along a longitudinal axis 322 and includes a central portion 242, a distal end portion 244, and a proximal end portion 246. The central portion 242 includes retention lugs 248 to prevent the charging handle assembly 200 from being completely withdrawn from an upper receiver 104 of a firearm (shown in FIG. 1) by engaging one or more surfaces of the upper receiver 104 at a point that is less than the full range of travel of the body 204. Only one retention lug 248 is visible in FIG. 2C, but it will be appreciated that some embodiments include two retention lugs 248 symmetrically disposed on opposing sides of the body 204. Moreover, the retention lugs 248, in some examples, can be integrated into the central portion 242 using, for example, welding or machining processes. In other examples, the retention lugs 248 can be separate and distinct components from the body 204 attached or otherwise secured to the central portion 242 using a fastener, such as a screw or bolt.

The distal end portion 244 of the body 242 is configured to move a bolt of a firearm in response to a user moving the charging handle assembly 200 rearward. In this example, the distal end portion 244 includes an arm 250 that can be configured to contact or otherwise engage a complementary portion (sometimes referred to as a "key") of a bolt carrier. With the arm 250 engaged with the key, rearward movement (i.e., toward a user or toward a proximal end of a firearm) of the charging handle assembly 200 also moves the bolt carrier and the bolt in a rearward direction. Moreover, the arm 250, in some examples, can be integrated within the distal end portion 244 and can be configured to extend in any number of orientations relative to the body 242 so as to engage a corresponding key in a firearm.

As best shown in FIG. 2D, the proximal end portion 246 of the body 204 defines structures to which the handle 208 and other elements can be attached, thus facilitating actuation of the assembly 200. In some examples, the proximal end portion 246 defines an elliptical or otherwise elongated slot 264 extending crosswise through the body 204 and which is configured to receive a cross pin 220. The cross pin 220 passes through the elongated slot 264 and connects the proximal end portion 246 and the handle 208. The elongated slot 264 enables the cross pin 220 to translate along the longitudinal axis 322 within the slot 264 when a user moves the handle 208. Shifting of the cross pin 220 back and forth within the elongated slot 264 facilitates the actuation of the latch(es) 212. In some other examples, the proximal end portion 246 further defines the spring bore 262 that is configured to receive the spring 224 that biases the latches 212 to a latched position.

As shown in the enlarged view of FIG. 2D, the proximal end portion 246 can include one or more guides 252 on lateral sides of the body 204. In one example, each guide 252 is a rail or block-like protrusion on sides of the body 204, where guides 252 facilitate slidably mounting the handle 208 to the body 204, the function of which described below in more detail below with reference to FIGS. 5A and 5B. The body 204 can include guides 252 on one or both sides of the body 204. In one example, opposite sides of the body 204 each include a multi-piece guide 252. In one such embodiment, the body 204 has a surface or break 256 between portions of each guide 252 that helps prevent misalignment of the handle 208 relative to the body 204 as the handle 208 moves towards and away from the user during use. The guides 252, in some instances, can be recessed below a top surface 205 or up from bottom surface 206 of the body 204, such as shown in FIG. 2D.

In the example shown in FIG. 2D, the guides 252 are parallel to the longitudinal axis 322, recessed below the top surface 205 of the body 204, and recessed above the bottom surface 206 of the body 204. In other words, the vertical thickness of the guides 252 is less than that of the body 204, where the guides 252 are positioned between the top and bottom surfaces 205, 206. In one embodiment, guides 252 have a vertical thickness of about 0.195 inch. Recessing the guides 252 relative to the top surface 205 thus forms recessed guide top surfaces 258. The recessed guide top surfaces 258 can provide a surface or rail over which the handle 208 can slide or otherwise translate during actuation. Optionally, each guide 252 can define one or more cam surfaces 260 adjacent the recessed guide top surfaces 258. For example, the cam surfaces 260 can be a fillet, chamfer, or other surface on the guides 252. The cam surfaces 260 facilitate rotation of the latches 212 during movement of the handle 208 relative to the body 204, in accordance with some embodiments.

The guides 252 and an intervening or adjacent portion of the body 204 can define the spring bore 262 and elongated slot 264 extending laterally therethrough. The spring bore 262 can be configured to receive spring 224, and the elongated slot 264 can receive the cross pin 220. The spring bore 262 is sized for the spring 224 to be retained substantially within the body 204 and so that the spring 224 can bias the latches 212 to the latched position. The spring 224 either expands or compresses depending on the forward or backward movement of the handle, and thereby facilitates the actuation of the latches 212. The spring bore 262 can be sized so that when the spring 224 is compressed, the plungers 228 on the spring 224 (shown in FIG. 2B) can be partially received within the spring bore 262. As can be seen, the spring bore 262 and elongated slot 264 can be parallel with one another, but this need not be the case in all instances. For example, in some instances, the spring bore 262 can be out of line from the elongated slot 264, depending on a given application. The spring bore 262, in one example, can include a circular cross-sectional shape with a diameter sufficient to receive the spring 224. When body 204 has a nominal vertical thickness of 0.298 inch, which is considered standard for AR-15 rifle variants, the nominal diameter of the spring bore 262 is about 0.128 inch in some embodiments. Larger and smaller diameters can be used, as will be appreciated.

The elongated slot 264 extends through the guides 252 and body 204 and is configured to receive the cross pin 220, as described above. The cross pin 220 is used to connect the handle 208 to the body 204. In addition, because the elongated slot 264 has a non-circular cross-section and is elongated along the longitudinal axis 322, the slot 264 allows the cross pin 220 to translate forward and backward (i.e., along the longitudinal axis 322) within the body 204. Forward and backward translation of the cross pin 220 within the slot 264 upon movement of the handle 208 facilitates the actuation of the latches 212, the mechanics of which are described below.

In some embodiments, such as shown in FIG. 2D, each guide 252 and/or part of the body 204 may also define a recess 254 adjacent the break 256 in the guide 252 or adjacent an end of the guide 252. For example, each recess 254 has a concavely curved profile as viewed from above and is sized to receive part of a latch 212. Each recess 254 provides clearance for operating a latch 212 and allows the latch 212 to maintain contact with the body 204 during movement of the handle 208. Each recess 254 may further include a cam surface 260 to engage a portion of the latch 212. The cam surface 260, in some examples, can be flat surfaces or convexly curved surfaces, depending on the application.

Turning now to FIG. 2E, a side view illustrates the proximal end portion 246 of the body 204 and elongated slot 264. In this example, the slot 264 has a racetrack shape (i.e., a rectangle with rounded or semicircular ends). The elongated cross-sectional shape of the slot 264 can be characterized by a height A and a length B. In general, dimensions A and B can be any size sufficient to receive the cross pin 220 and to enable the translation of the cross pin 220 within the slot 264. In one example, height A is about 0.128 inch while length B is about 0.178 inch. Other dimensions for height A and length B can be used, as will be appreciated.

Figure 3A:
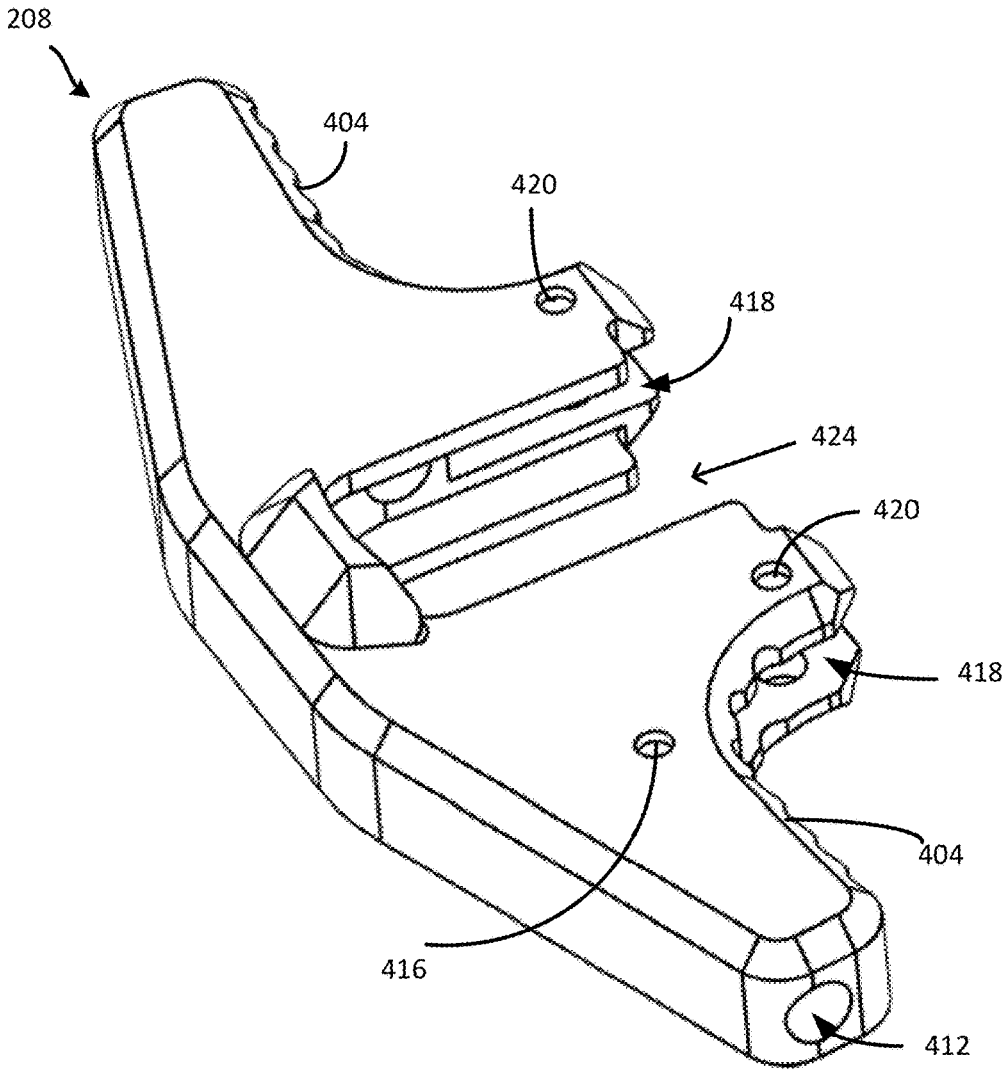
FIG. 3A is a top and rear perspective view of the handle of the charging handle assembly shown in FIGS. 2A-2B, in accordance with an embodiment of the present disclosure.
Figure 3B:
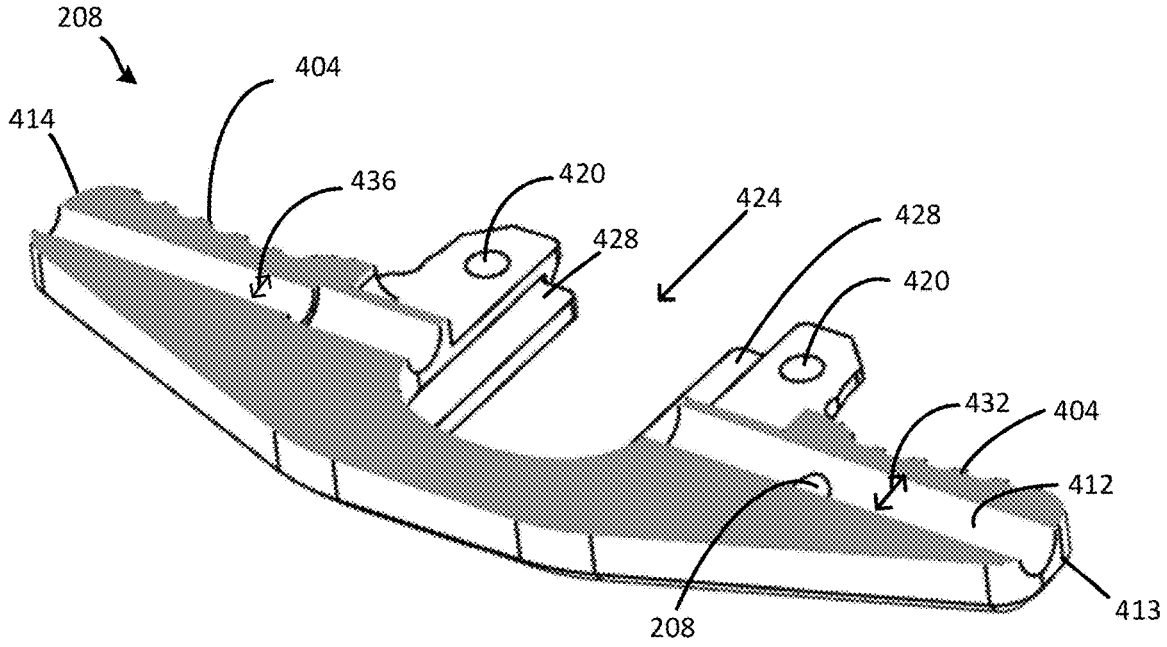
FIG. 3B is a cross-sectional top and rear perspective view of the handle of the charging handle assembly shown in FIG. 3A, in accordance with an embodiment of the present disclosure.

Referring now to FIGS. 3A and 3B, a handle 208 is illustrated, in accordance with an embodiment of the present disclosure. FIG. 3A is a top and rear perspective view of the handle 208 of the charging handle assembly shown in FIGS. 2A-2B and. FIG. 3B is a cross-sectional view of the handle 208 shown in FIG. 3A. As a general matter, the handle 208 is the portion of the charging handle assembly 200 that the user grasps to move the handle 208 within the upper receiver 104 of the firearm 100. As can be seen in FIGS. 3A and 3B, the handle 208, in some examples, can be an ambidextrous grip so that the user can grasp and operate the charging handle 208 from either side of the firearm 100. In other examples, the handle 208, can be configured for particular manner of use, such as left-hand or right-hand use. The handle 208 can be manufactured from polymeric materials using fabrication processes and techniques, such as injection molding. In some examples, the handle 208 can be made from two or more polymeric materials, such as an overmolded configuration. The handle 208, in some examples, can include handle grips 404, a transverse bore 412, recesses 418, holes 420, and a body mounting slot 424.

The handle grips 404 of the handle 208 allow the user to comfortably and easily grasp the handle 208 and pull on the charging handle assembly 200 to ready the firearm 100 for a next firing cycle. In one example, the handle 208 includes two handle grips 404 on opposite sides of the body mounting slot 424 to enable ambidextrous use. As can be seen, the handle grips 404, in some examples, can be symmetrically positioned about a portion of the handle 208 that engages the body 204. The handle grips 404 can include one or more curved surfaces in which to receive one or more fingers of a firearm operator's hand. The curved surfaces can extend along a vertical surface of the handle 208 or a portion thereof. The curved surfaces can be uniform in size or include different radius to accommodate for fingers of different sizes.

The handle 208 can also include a transverse bore 412 to receive a cross pin 220 to slidably or otherwise movably attach the handle 208 to the body 204. The transverse bore 412, in some examples, can be a through-hole that passes completely through the handle 208. Such a configuration allows access to both sides of the cross pin 220 (e.g., using a punch or other tooling) for efficient removal of the cross pin 220 from the handle 208 to facilitate disassembly of the charging handle assembly 200. In other cases, the bore 412 can be a blind hole that passes through a portion of the handle 208. In yet other embodiments, the transverse bore 412 includes a region of smaller diameter on one end, such as shown in FIG. 3B, so as to retain the pin 220 yet to allow access with a punch or the like. No matter its configuration, the bore 412, in some examples, can include a first end 413 on one side of the handle 208 and a second end 414 opposite to the first end 413 and on the other side of the handle 208 to allow for installation of the cross pin 220 into the body 204. In this one example, the bore 412 includes a circular cross-sectional shape. As can be seen in the cross-sectional view of FIG. 3B, in some examples the first end 413 can include a first diameter 432 that is different than a second diameter 436 of the second end 414. In particular, the first diameter 432 can be configured to receive the cross pin 220, while the second diameter 436 acts like a retention device to prevent the cross pin 220 from passing completely through the bore 412. To maintain the cross pin 220 within the first end 413, the handle 208 can further include a hole 416 configured to receive a handle pin 236, such as spring pin. When installed in the handle 208, the handle pin 236 passes through the bore 412 to prevent unintentional removal of the cross pin 220 along the bore 412. In other examples, the bore 412 can include a uniform diameter with handle pin 236 or other fastening devices (e.g., retainers or clips) installed on both sides of the cross pin 220 to retain the pin 220 within the handle 208.

As also shown in FIG. 3A, the handle 208 further includes one or more recesses 418 each configured to receive part of a latch 212 so that the latch 212 can rotate freely within the handle 208. In some other examples, the handle 208 can include a single recess 418 to receive a single latch 212 depending on a given application. Each recess 418, in some examples, can be located at the distal end of the handle 208 and adjacent to the body mounting slot 424. As can be seen, the handle 208 can include multiple recesses 418 so that the handle 208 can receive multiple latches 212 for engaging an upper receiver (e.g., upper receiver 104 of the firearm 100). To this end, the latches 212, for example, are one on each side of the handle 208. In some examples, latches 212 can be secured to the handle 208 using a fastener, such as a screw or a pin (e.g., latch pin 240 (shown in FIG. 2B).

The handle 208 can further include a body mounting slot 424 configured to slidably engage the body 204, such that the handle 208 can move relative to the body 204 to actuate the latches 212. The body mounting slot 424, in some examples, is configured to receive the proximal end portion 246 of the body 204. For example, as shown in FIG. 3B, the body mounting slot 424 can further include surfaces 428 that contact or otherwise receive complementary surfaces of the guides 252 (e.g., guide top surfaces 258 and guide bottom surfaces 259 shown in FIG. 2D), such that the handle 208 and body 204 are in sliding contact with each other. The surfaces 428, in some examples, can be adjacent to edges of the body mounting slot 424, for example top and bottom edges. In addition, the surfaces 428 can include a width that is equal to or less than a width of the corresponding surfaces of the guides 252. Numerous other handle configurations will be apparent in light of the present disclosure.

Each latch 212*c* an be mounted to the handle 208 so that it can pivot relative to the body 204. As will be described below, actuating the latch(es) 212 by using the handle 208 enables ambidextrous actuation of the charging handle assembly 200, where movement of the handle 208 in a rearward direction causes the distal portion of the latches 212 to pivot away from the body 204. Each latch 212 can be attached to the handle 208 using a latch pin 240, such as a coiled spring or roll pin.

Figure 4:
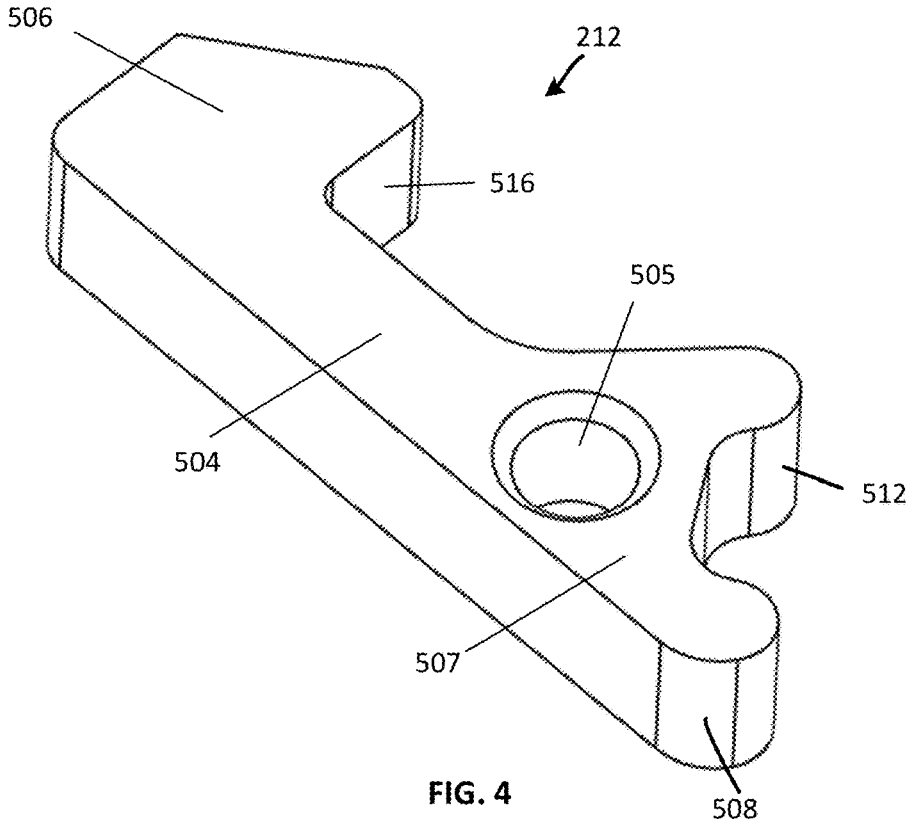
FIG. 4 is a perspective view of a latch of the charging handle assembly shown in FIGS. 2A-2B, in accordance with embodiment of the present disclosure.

FIG. 4 is a perspective view of a latch 212 for a charging handle assembly 200, in accordance with an embodiment of the present disclosure. One or more latches 212, in general, can secure the charging handle assembly 200 to a firearm receiver. In addition, each latch 212 pivots or otherwise moves in the opposite direction when the handle is released forward by a user. Each latch 212, in an example embodiment, includes a latch body 504 with a first latch end portion and a second latch end portion 507, a latch pin aperture 505, a first protrusion 508, a second protrusion 512, and a catch surface 516.

The latch body 504 interfaces with or otherwise engages the handle 208. For example, the latch body 504 can be configured to be received within a recess 418 of the handle 208 so that the latch 212 can rotate relative to the handle 208 and body 204. In addition, the latch body 504 can include a latch pin aperture 505 through the second latch end portion to receive the latch pin 240 and so that the latch 212 is pivotally attached to the handle 208.

In this example, the second latch end portion 507 has a first protrusion 508 that interfaces with the plunger 228 on the spring 224. As can be seen, the first protrusion 508 can extend from the second latch end portion 507 in a direction that is aligned with the latch body 504. In other examples, the first protrusion 508 can extend transversely from the latch body 504. Moreover, the first protrusion 508 extends from the latch body 504 with a length that allows the first protrusion 508 to be in continuous contact with the plungers 228 as the latch 212 is rotated from a latched position to an unlatched position. In addition, the first protrusion 508, in some examples, includes a rounded or otherwise curved end to allow the protrusion 508 to move along an exterior surface of the plungers 228 as the latch 212 is rotated. The first protrusion 508 can have a height equal to that of the latch body 504 (e.g., from a top surface of the latch 212 to a bottom surface of the latch 212). In other examples, the height of the first protrusion 508 can different (e.g. less than) than that of the latch body 504, so as to improve contact with the plunger 228.

The second latch end portion 507 can also include a second protrusion 512 that interfaces with the body 204 so as to rotate the latch 212 during movement of the handle 208 (e.g., toward a proximal end of the body 204). In addition, the second protrusion 512 also facilitates movement of the handle 208 (e.g., toward a distal end of the body 204) after the handle 208 has been released by the user. As can be seen, the second protrusion 512, in some examples, extends transversely from the latch body 504, such as defining an angle from 35° to 90° with the latch body 504. In some examples, the second protrusion 512 can be in continuous contact with the body 204 as the latch 212 is rotated from a latched position to the unlatched position. The second protrusion 512, in some examples, can include a rounded or otherwise curved end to engage the body 204, such that the protrusion 512 can maintain contact with a surface (e.g., cam surface 260) of the body 204 as the latch 212 rotates. As with the first protrusion 508, the second protrusion 512 can have a height that is the same as or different from that of the latch body 504 (e.g., from a top surface of the latch 212 to a bottom surface of the latch 212). In one example, the height of the second protrusion 512 is smaller than that of the latch body 504, so as to improve contact with the body 204.

The first latch end portion 506 includes a catch surface 516 configured to engage with the upper receiver 104 of the firearm 100. As can be seen, the catch surface 516 can extends transversely away from the latch body 504. In one example, the catch surface 516 can extend laterally away from the body 504 so as to define an angle from 60° to 120°, including about 90°, with the latch body 504. The catch surface 516 can extend along an entire height of the latch 212 (e.g., from a top surface of the latch 212 to a bottom surface of the latch 212). In other examples, the catch surface 516 can be along a portion of a vertical surface of one end of the latch 212. In one example, the catch surface 516 can be or include a rounded or curved surface to maintain contact with the upper receiver 104 of the firearm 100.

Each latch 212 can be manufactured using fabrication processes and techniques, such as machining, casting, welding, metal injection molding (MIM), and combinations thereof. The latches 212 can be manufactured from materials, such as carbon steel, stainless steel, aluminum, and alloys. In some examples, the latches 212 can be heat treated to improve mechanical properties, such as tensile strength.

Figure 5A:
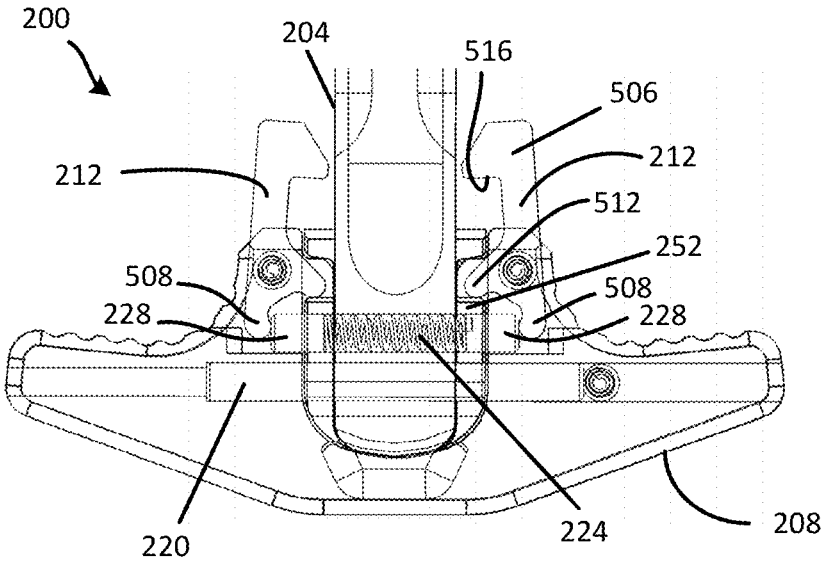
FIG. 5A is a semi-transparent top view of the charging handle assembly of FIG. 2A shown in a latched position, in accordance with an embodiment of the present disclosure.

FIG. 5A is a top view of the charging handle assembly 200, in which latches 212 are in a latched position. In such a configuration, the handle 208 is in contact with or otherwise seated onto the body 204, as indicated by the lack of a gap between the handle 208 and the proximal end of the body 204. With the handle 208 seated against the body 204, the spring 224 is extended so that the plungers 228 apply a force onto a portion of the latches 212 (e.g., first protrusion 508). As can be seen, the plungers 228 can remain partially within the body 204 when the spring 224 is fully extended and the latches 212 are in the latched position. As a result, the latches 212 can be positioned to extend along the body 204 to engage an upper receiver 104 (shown in FIG. 1). In some examples, the latches 212 can be rotated beyond a position in which they are parallel with the body 204. In the latched position, and without another structure (e.g., upper receiver 104) to stop pivoting movement of the latch 212 towards the body 204, each latch 212 pivots to contact the body 204 (e.g., second protrusion 512 contacts guide 252) and plunger 228. When the charging handle assembly 200 is installed in the upper receiver and the latch(es) 212 engage the upper receiver, the first latch end portion 506 is pivoted inward with the catch surface 516 in contact with a corresponding feature on the upper receiver 104 (shown in FIG. 1).

To withdraw the charging handle assembly 200 from the upper receiver, the user grasps and pulls rearward on the handle 208, causing it to move relative to the body 204. This relative movement also draws the cross pin 220 rearward and pivots the latches 212 to an unlatched position, such as shown in FIG. 5B.

Figure 5B:
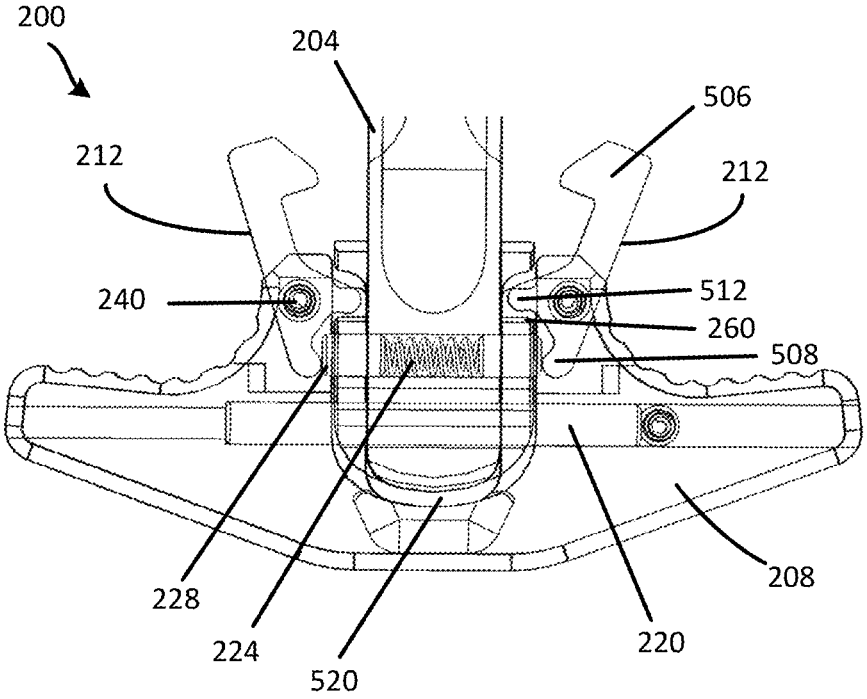
FIG. 5B is a semi-transparent top view of the charging handle assembly of FIG. 2A shown in an unlatched position, in accordance with an embodiment of the present disclosure.

FIG. 5B is a top view of the charging handle assembly 200 of FIG. 5A, in which latches 212 are in an unlatched position. When the handle 208 is pulled rearward towards the user, the rearward movement of the handle 208 relative to the body 204 urges each latch 212 to pivot about the latch pin 240. In some embodiments, the range of pivot movement is restricted due to the engagement of the second protrusion 512 with the cam surfaces 260 of the body 204. As the handle 208 and latches 212 move rearward, cam surface 260 contacts the second protrusion 512, causing the latch first end portion 506 to pivot outward from the body 204. Pivoting the latch 212 towards the unlatched position compresses the spring 224 by pivoting the first protrusion 508 inward in contact with the plunger 228. As a result, the plungers 228 move substantially within the body 204 as the spring 224 becomes more compressed and the catch surface 516 disengages from a corresponding structure on the upper receiver, thus unlatching. Drawing the handle 208 rearward also causes the cross pin 220 to shift rearward within the elongated slot 264 to occupy a proximal end of the elongated slot 264. In such a configuration, the handle 208 is no longer in contact with or otherwise seated against the proximal end of the body 204, as indicated by the gap 520 therebetween. Once the catch surface 516 of each latch 212 is disengaged from the upper receiver, the charging handle assembly 200 also becomes free to move rearward relative to the upper receiver 104 (shown in FIG. 1).

Upon release of the handle 208 by the user, the spring 224 expands to rotate the latches 212 to the latched position. As the latches 212 rotate, the latches 212 also move the handle 208 forward and against the body 204. The forward movement of the handle 208 positions the latches 212 so that the latches 212 can engage a recess or other feature on the upper receiver 104 to securely stow the charging handle assembly 200 within the receiver 104.

Charging Handle with Alternate Side Latch

Figure 6:
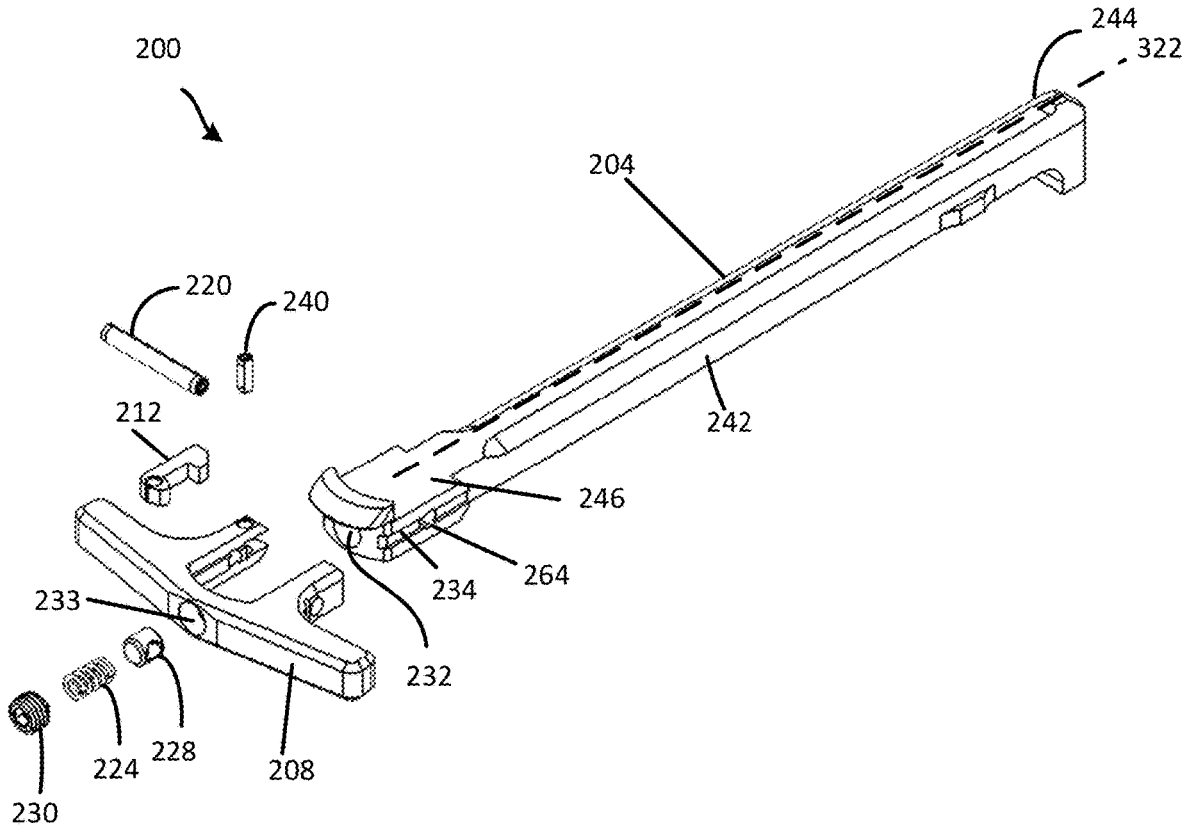
FIG. 6 is an exploded top and rear perspective view of a charging handle assembly with a single pivoting side latch, in accordance with an embodiment of the present disclosure.

FIG. 6 is an exploded, top and rear perspective view of a charging handle assembly 200 with a pivoting latch 212, in accordance with another embodiment of the present disclosure. In this example embodiment, the charging handle assembly 200 includes a body 204, a handle 208, a latch 212, a cross pin 220, a spring 224, a plunger 228, a retainer 230, and a latch pin 240. In this example, the body 204 includes a proximal end portion 246, a distal end portion 244, and a central portion 242. The body 204 extends along longitudinal axis 322. Although the charging handle assembly 200 shown in FIG. 6 includes a single latch 212, it should be appreciated that the assembly 200 may include multiple latches 212, such as one on each side of the body 204 in a symmetrical arrangement. As some features of the assembly 200 have been discussed above for other embodiments of charging handle assembly 200, they will not be repeated below.

The body 204 can be configured to slidably receive the handle 208. The body 204 can also at least partially connect to and/or be placed in contact with the latch 212 so as to facilitate actuation of the latch 212 upon the movement of the handle 208. In one example, the body 204 can be connected to the handle 208 via a cross pin 220 received within an elongated slot 264 (e.g., a slot having an elliptical or "racetrack" cross-sectional shape) through a proximal end portion 246 of the body 204. The elongated slot 264 enables the cross pin 220 to shift along longitudinal axis 322 within the slot 264 upon the movement of the handle 208. The movement of the cross pin 220 within the slot allows the handle 208 to move relative to the body 204 while remaining attached to the body 204, as will be described in more detail in FIGS. 9A and 9B. In both the latched or unlatched positions, the body 204 remains attached to the handle 208 via the cross pin 220.

The charging handle assembly 200 can be configured with the spring 224 oriented axially to engage the cross pin 220, which facilitates the actuation of one or more latches 212 upon the movement of the handle 208. Movement of the handle 208 causes the cross pin 220 to shift axially within the elongated slot 264. Actuation of the latch(es) 212 can be further facilitated by the interaction of each latch 212 with one or more cam surfaces 260 on the proximal end portion 246 of the body. In one example, the cam surface 260 can be an inner surface of a semi-elliptical cavity defined in the side of the body 204 (shown in FIG. 7). Such a configuration can include a more robust latch design that can be easily manufactured and/or otherwise assembled with other charging handle assembly components, in accordance with some embodiments.

In one example, the spring 224 and plunger 228 are received at least in part in an axial bore 232 in the proximal end portion 264 of the body 204. As shown in FIG. 6, the plunger 228 may define a crosswise opening sized and oriented for passage of the cross pin 220. In one such embodiment, the plunger 228 can be mounted on the cross pin 220 and provide a surface to engage the spring 224. As the plunger 228 connects the cross pin 220 and the spring 224, movement of the spring 224 induces a movement in the cross pin 220. In some embodiments, the spring 224 is retained in contact with the plunger 228 by a retainer 230, such as a set screw, plug, or other suitable structure that is removably installed in a proximal bore in the handle 208. Thus, in its assembled form, the spring 224 is maintained between the retainer 230 and the plunger 228, and therefore applies an axial biasing force between the body 204 and the handle 208. In one example, the retainer 230 interfaces with the handle 208 when the assembly 200 is in a latched position.

Figure 7:
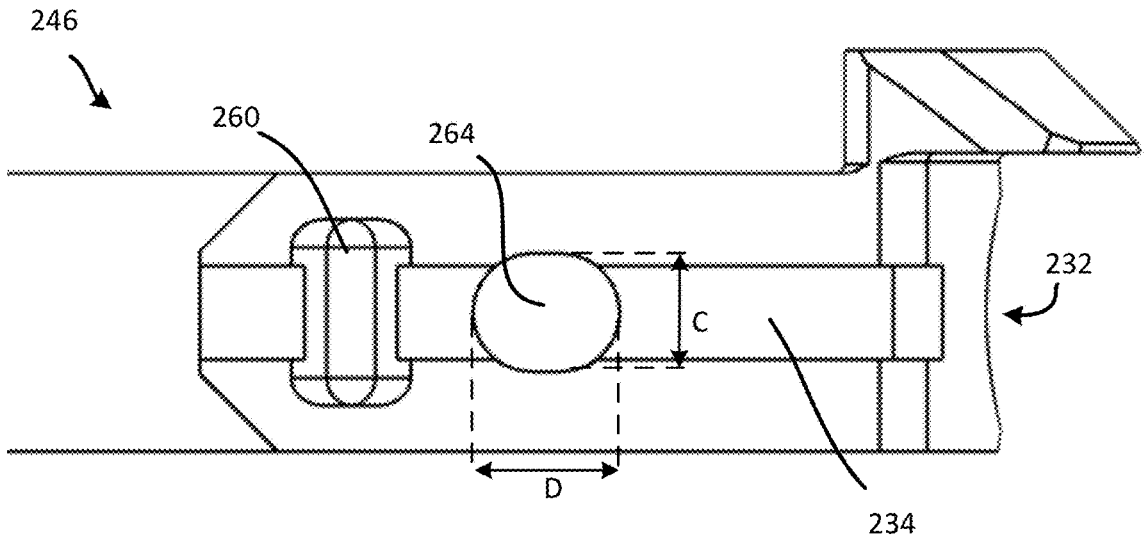
FIG. 7 is a side view showing the left side of the proximal end portion of the body shown in FIG. 6, in accordance with an embodiment of the present disclosure.

Referring now to FIG. 7, an enlarged side view shows the proximal end portion 246 of the body 204, in accordance with an embodiment of the present disclosure. The proximal end portion 246 defines structures to which the handle 208, the latch 212, and other elements can be attached, thus facilitating actuation of the assembly 200. The structures at the proximal end portion 246 may include an elongated slot 264 and a cam surface 260. The elongated slot 264 can receive a cross pin 220 and enable the cross pin 220 to translate within the slot so as to facilitate the movement of the handle 208 relative to the body 204. In addition, the cam surface 260 can be configured to interact with the latch 212 to pivot the latch 212 when the handle 208 is moved axially with respect to the body 240.

In one example, the proximal end portion 246 includes an elongated slot 264, a channel 234 defined in the side of the body 204, and a cam surface 736. The elongated slot 264 can receive the cross pin 220 so as to movably connect the handle 208 to the body 204. In particular, the elongated slot 264 allows the cross pin 220 to shift back and forth linearly within the slot 264 so as to facilitate the backward and forward movement of the handle 208 relative to the body 204. In one embodiment, the cross pin 220 has a circular cross-section with a diameter that is smaller the minor diameter or height C of the elongated slot 264. When the elongated slot 264 has an elliptical cross-sectional shape, it has a minor axis and a major axis with dimensions C and D, respectively. When the elongated slot 264 has a racetrack shape, dimensions C and D refer to the height and length, respectively. The dimensions C and D can be any size sufficient to receive the cross pin 220 and allow the cross pin 220 to translate within the slot 264. In one example, dimension C is about 0.128 inch and dimension D is about 0.178 inch. Other dimensions can be used, as will be appreciated.

The proximal end portion 246 further includes an axial bore 232 (shown in FIG. 6) to receive the spring 224. In addition to the spring 224, the axial bore 232 can also be configured to receive plunger 228 and a retainer 230, as shown in FIG. 6. In some examples, the axial bore 232 can include a circular cross-sectional shape and can have a diameter equal to or greater than the diameter of the spring 224 and plunger 228. In addition, the axial bore 232, in some examples, can intersect the elongated slot 264 to provide space in which to receive the plunger 228 so that the cross pin 220 can move through a full range of motion within the slot 720.

The proximal end portion 246 can further include a channel 234 to slidably receive a corresponding portion of the handle 208. The channel 234 can be located on either side or both sides of the body 204 and is configured to engage complimentary tabs on the handle 208 (as described further below with reference to FIG. 8). In some other example embodiments, the body 204 can include a single channel 234 on one side of the body 204. In one embodiment, the channel 234 can be a rectangular groove.

The proximal end portion 246 can further include a cam surface 260 to receive at least a part of the latch 212 so as to facilitate actuation of the latch 212 upon rearward movement of the handle 208. In some examples, the cam surface 260 can be defined by an inner surface of a recess, such as a semi-circular inner surface, in one side of the body 204. In yet another example, the cam surface 260 can be an inner surface of a semi-elliptical cavity in the body 204. The cam surface 260 includes a curved inner surface, which can be either a smooth, machined surface or an unfinished or rough-machined surface, for example. In this one example, the cam surface 260 is smooth so as to allow the latch 212 to rotate against or otherwise move along the cam surface 260 when the handle 208 is pulled by a user, as described further below in FIGS. 9A and 9B.

Figure 8:
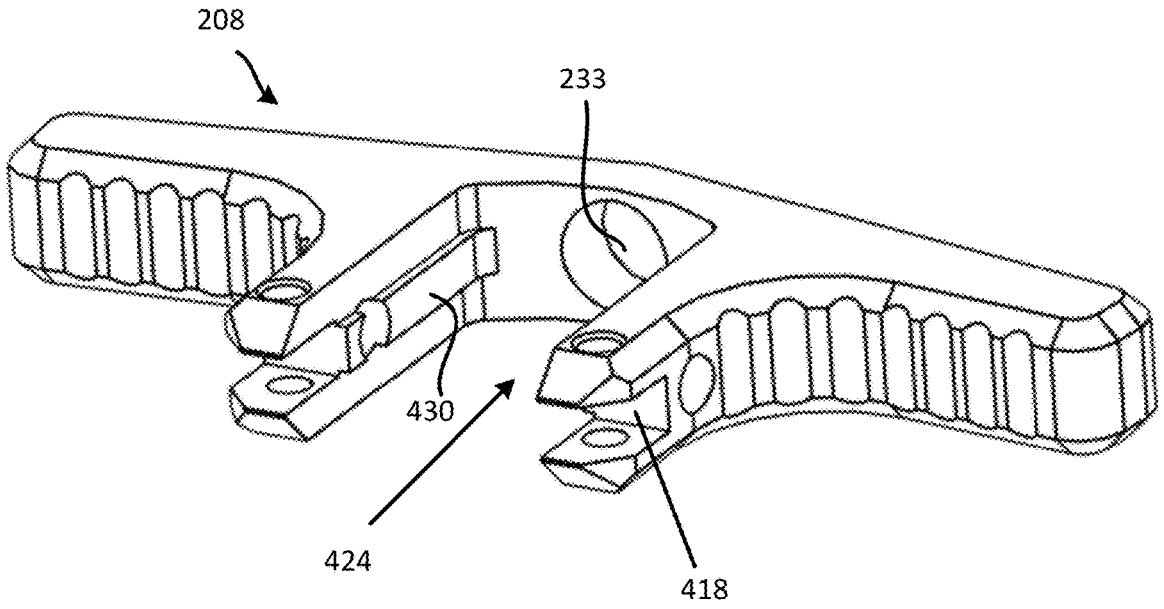
FIG. 8 is a top and front perspective view of a handle shown in FIG. 6, in accordance with an embodiment of the present disclosure.

FIG. 8 is a front perspective view of the handle 208 shown in FIG. 6, in accordance with an embodiment of the present disclosure. The handle 208 allows the user to comfortably pull the charging handle assembly 100 to ready the firearm for a next firing cycle. The handle 208, in some examples, can include a body mounting slot 424 to receive the proximal end portion 246 of the body 204. For example, the body mounting slot 424 can include one or more rails 430 that can interface with the complementary channel 234 of the body (shown in FIG. 7). In one example, opposite sides of the body mounting slot 242 have a rail 430. The interface between the channel 234 and rail 430 maintains alignment of the body 204 and handle 208 as the handle 208 slides along the proximal end portion 246. The shape and size of each rail 430 can complement and mate with the channel 234 at the proximal end portion 264 of the body 204. For example, each rail 430 can have a rectangular, rounded, or other cross-sectional shape.

The handle 208, in some examples, can further include a recess 418 to receive the latch 212. In one such embodiment, the recess 418 is a slot that enables the latch 212 to be secured to the handle 208 using a latch pin 240. The recess 418 can be sized to allow the latch 212 to freely rotate within the recess 418 during latching and unlatching. In this one example, the recess 418 is rectangular. The handle 208, in some examples, can further include a proximal bore 233 that facilitates the connection of the body 204 to the handle 208. The proximal bore 233 includes a retainer 230 that retains the spring 224 between the body 204 and the handle 208. In one example, the proximal bore 233 is threaded for a retainer 230 configured as a machine screw or the like.

Figure 9A:
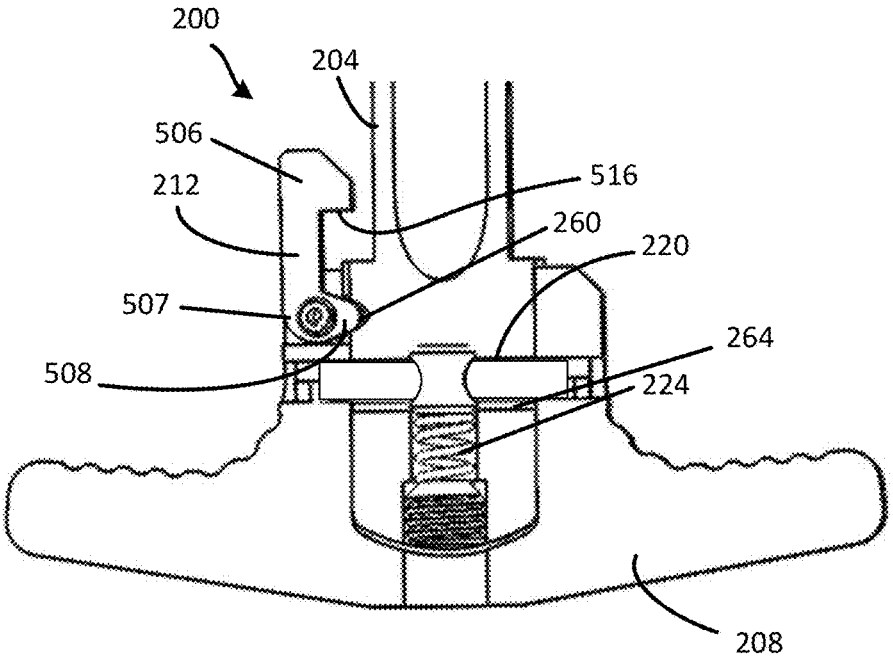
FIG. 9A is a top sectional view of the charging handle assembly of FIG. 6 showing the latch in a latched position, in accordance with an embodiment of the present disclosure.
Figure 9B:
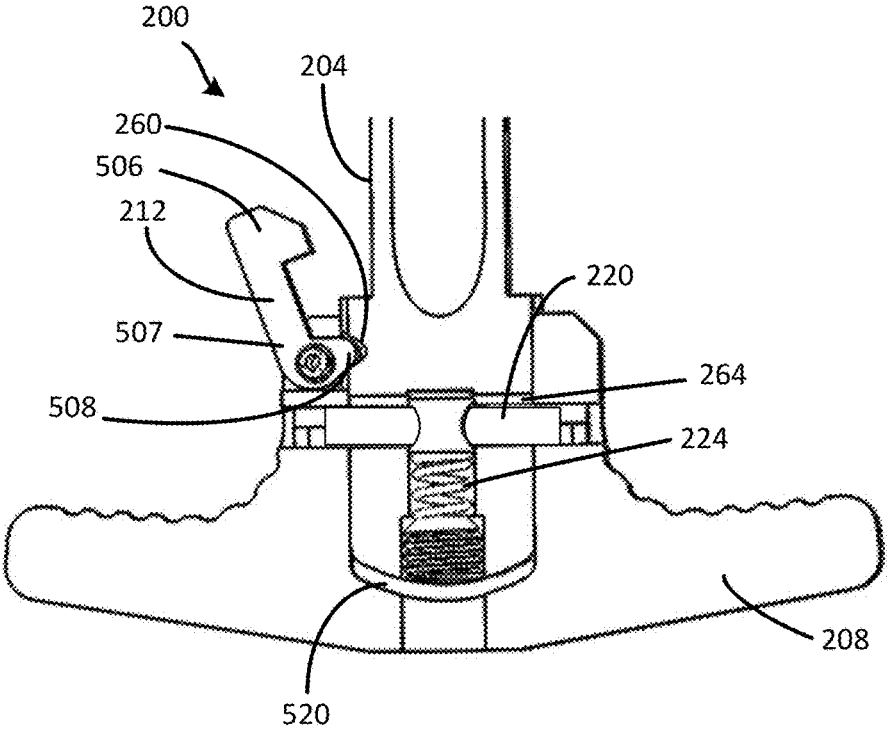
FIG. 9B is a top sectional view of the charging handle assembly of FIG. 6 showing the latch in an unlatched position, in accordance with an embodiment of the present disclosure.

In some examples, the assembly 200 can further include a cross pin 220, as shown in FIGS. 6, 9A and 9B. In one example, the cross pin 220 connects the handle 208 and the body 204 by passing through the elongated slot 264 of the body 204. The elongated slot 264 allows the cross pin 220 to shift back and forth linearly within the slot 264 with corresponding movement of the handle 208. The movement of the cross pin 220 within the slot 264 further supports interaction between the cam surface 260 and the latch 212 so as to facilitate actuation of the latch 212. The cross pin 220 in some examples is round and has a single or otherwise uniform diameter. In other examples, the cross pin 220 can include a first diameter that is different from a second diameter. The second diameter can act as a retention feature to prevent the cross pin 220 from passing completely through the handle 208 during installation.

FIG. 9A is a top view of the charging handle assembly 200 with the latch 212 in a latched position, such as when the assembly 200 is stowed within an upper receiver 104 of the firearm (shown in FIG. 1). In the latched position, the handle 208 is in contact with or otherwise seated onto the body 204, as shown. The spring 224 applies a force against the plunger 228 to move the cross pin 220 to a distal end of the slot 264. In some examples, the cross pin 220 can be in contact with the distal end of the slot 264 when the handle 208 is in the latched position, but this need not be the case in all instances.

The latch 212, as shown, is substantially parallel to the body 204 so that it can engage the upper receiver. The latch 212 has a catch surface 516 on a first latch end portion 506 and pivots about a second latch end portion 507. The second latch end portion 507 includes a protrusion 508 that interacts with the cam surface 260. In the latched position, little or no gap exists between a proximal end of the body 204 and the handle 208. To withdraw the charging handle assembly 200 from the upper receiver, the user pulls rearwardly on the handle 208, causing it to move relative to the body 204, and in turn rotate the latch 212 to an unlatched position, as described further below.

FIG. 9B is a top view of the charging handle assembly 200 with a latch 212 in an unlatched position so that the assembly 200 can move relative to the upper receiver (shown in FIG. 1). As shown, the handle 208 has moved proximally with respect to the body 204, as evidenced by the gap 520 therebetween. When the handle 208 is pulled rearward, the cross pin 220 shifts rearward within the slot 264. This causes compression of the spring 224. Rearward movement of handle 208 further facilitates the interaction of the protrusion 508 on the latch second end portion 507 with the cam surface 260, thereby causing the latch 212 to pivot outward from the body (in an anti-clockwise rotation). When the user releases the handle 208, the spring 224 is allowed to extend, thus moving the cross pin 220 to the distal end within the elongated slot 264. The spring force re-seats the handle 208 against the proximal end portion 246 of the body 204 and substantially eliminates the gap 520. As the handle 208 moves forward, the latch 212 interacts with the cam surface 260 to rotate the first latch end portion 506 towards the body 204 to a position where it can engage the upper receiver 104 (shown in FIG. 1).

Ambidextrous Charging Handle with Horizontal Sliding Latch

Figure 10:
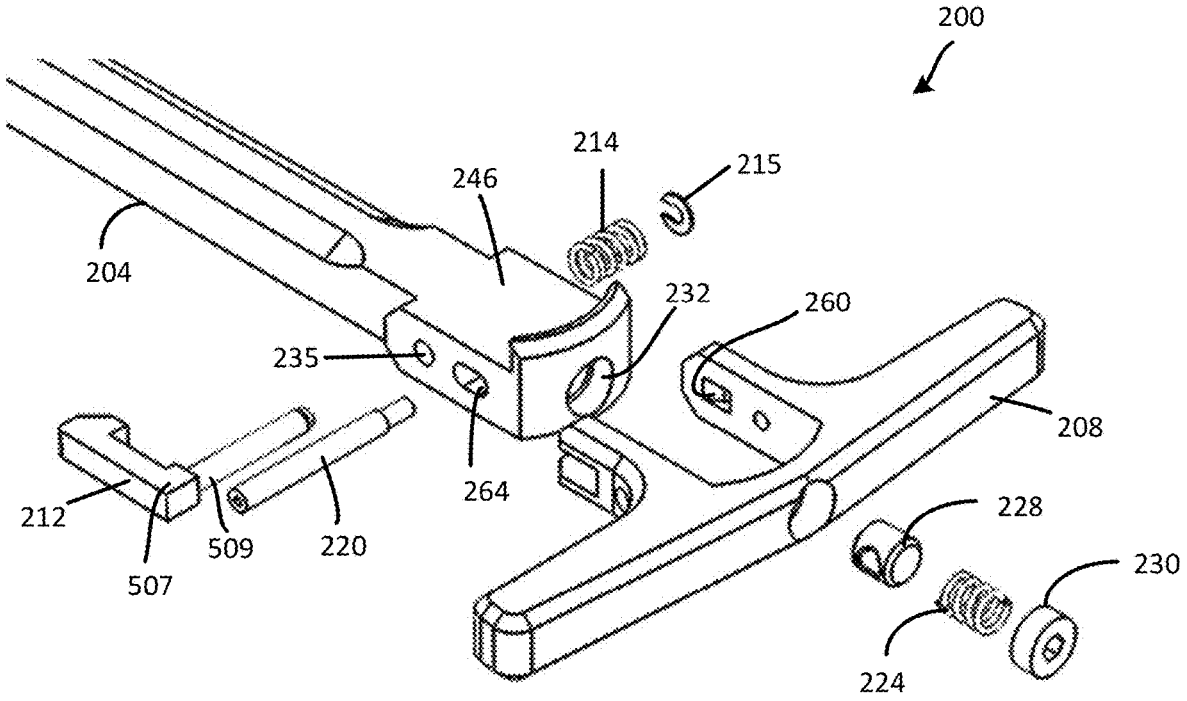
FIG. 10 is an exploded top and rear perspective view of part of a charging handle assembly with a horizontal sliding latch, in accordance with an embodiment of the present disclosure.

Referring now to FIG. 10 an exploded, top and rear perspective view shows a charging handle assembly 200 with a horizontal sliding latch 212, in accordance with an embodiment of the present disclosure. In one example embodiment, the charging handle assembly 200 includes a body 204, a handle 208 slidably attached to the body 204 with a cross pin 220, a latch 212, a latch spring 214, a clip 215, a spring 224 between the handle 208 and the body 204, a plunger 228, and a retainer 230. In addition, some features of the assembly 200 have been previously described in relation to other embodiments and need no further description.

In this example, the latch 212 can translate laterally relative to the body 204 upon actuation of the handle 208, rather than pivoting, as described above for other embodiments. As described in previous embodiments, the proximal end portion 246 of the body 204 includes an elongated slot 264. A cross pin 220 extends though the elongated slot 264 and connects the handle 208 to the body 204. The cross pin 220 can shift forward or backward within the elongated slot 264 with movement of the handle 208. Shifting of the cross pin 220 within the slot 264 enables movement of the handle 208 relative to the body 204, and thereby enables actuation of the latch 212.

Actuation of the latch 212 can be further facilitated by a cam surface 260 on the handle 208 which deflects the latch 212 laterally when the handle 208 is moved rearward relative to the body 204. The latch 212 includes a latch post 509 extending transversely from a second latch end portion 507. The latch post 509 passes through a crosswise opening 235. Rearward movement of the handle 208 relative to the body 204 causes the latch 212 to translate laterally due to engagement between the free end of the latch post 509 and the cam surface 260 on the handle 208.

The proximal end portion 246 of the body 204 further includes an axial bore 232 to receive the spring 224 so as to facilitate movement of the handle 208 relative to the body 204. The axial bore 232 further receives the plunger 228 at a first end of the spring 224 and the retainer 230 on a second end of the spring 224. Some features of the axial bore 232, spring 224, plunger 228, and retainer 230 have been previously described and are not repeated below.

Figure 11A:
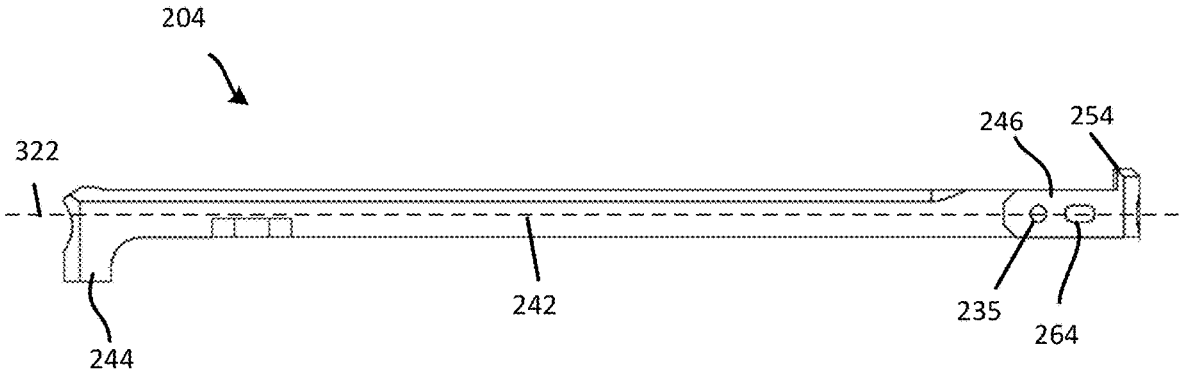
FIG. 11A is a side view of the body of the charging handle assembly of FIG. 10, in accordance with an embodiment of the present disclosure.
Figure 11B:
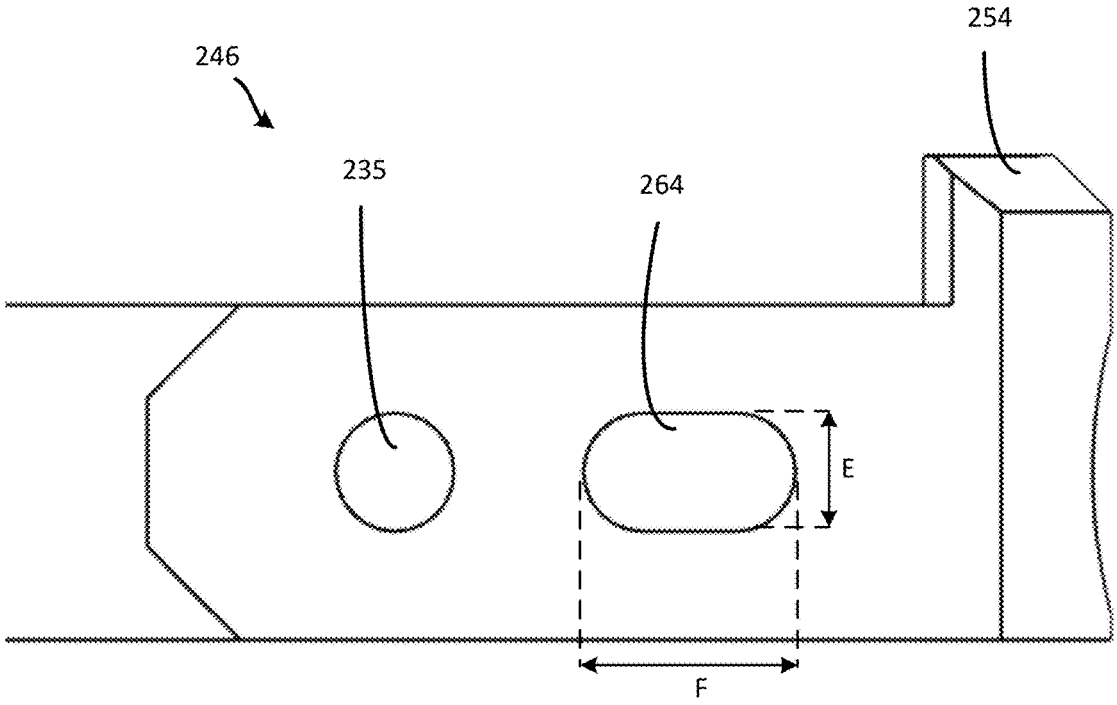
FIG. 11B is a side view showing the left side of the proximal end portion of the body shown in FIG. 11A, in accordance with an embodiment of the present disclosure.

FIG. 11A is a side view of a body 204 and FIG. 11B is an enlarged view of a proximal end portion 246 of the body 204, in accordance with an embodiment of the present disclosure. The body 204, in an example embodiment, extends along a longitudinal axis 322 and includes a central portion 242, a distal end portion 244, and a proximal end 246. Some features of the central portion 242 and the distal end portion 244 have been previously described in relation to embodiments discussed above and are not repeated below. The proximal end portion 246, similar to the previous embodiments, supports the handle 208. In some examples, the proximal end portion 246 may also include the latch 212. In some examples, the proximal end portion 246 includes an elongated slot 264 configured to receive the cross pin 220, a crosswise opening 235, an axial bore 232 (shown in FIG. 10), and a mount 254. The slot 264, as can be seen in FIG. 11B, can include a minor axis or height and a major axis or length as indicated by dimensions E and F, respectively. In general, dimensions E and F can be any size sufficient to receive the cross pin 220. In one example, dimension E is about 0.128 inch and dimension F is about 0.178 inch. Other dimensions can be used, as will be appreciated.

The proximal end portion 246 further includes a crosswise opening 235 that is configured to receive the latch post 509. The crosswise opening 235 can take any form including a circular or a polygonal form. In this example, the crosswise opening 235 is circular. The crosswise opening 235 can include a first internal diameter and a second internal diameter wherein the second internal diameter is larger than the first internal diameter, such as shown in FIG. 10. The crosswise opening 235 with the second internal diameter further receives a latch spring 214 which is retained within the crosswise opening 235 by a spring plate 215. In one example, the spring plate 215 is secured to the latch post 509 adjacent the free end. In addition, the latch spring 214 can be disposed over and around the latch post 509.

The proximal end portion 246 further includes a mount 254 so as to keep the proximal end portion 246 of the body 204 aligned with the handle 208 while the handle 208 is pulled rearward by the firearm operator. In one embodiment, the mount 254 includes a lower surface that sits over a top portion of the handle 208.

Figure 12:
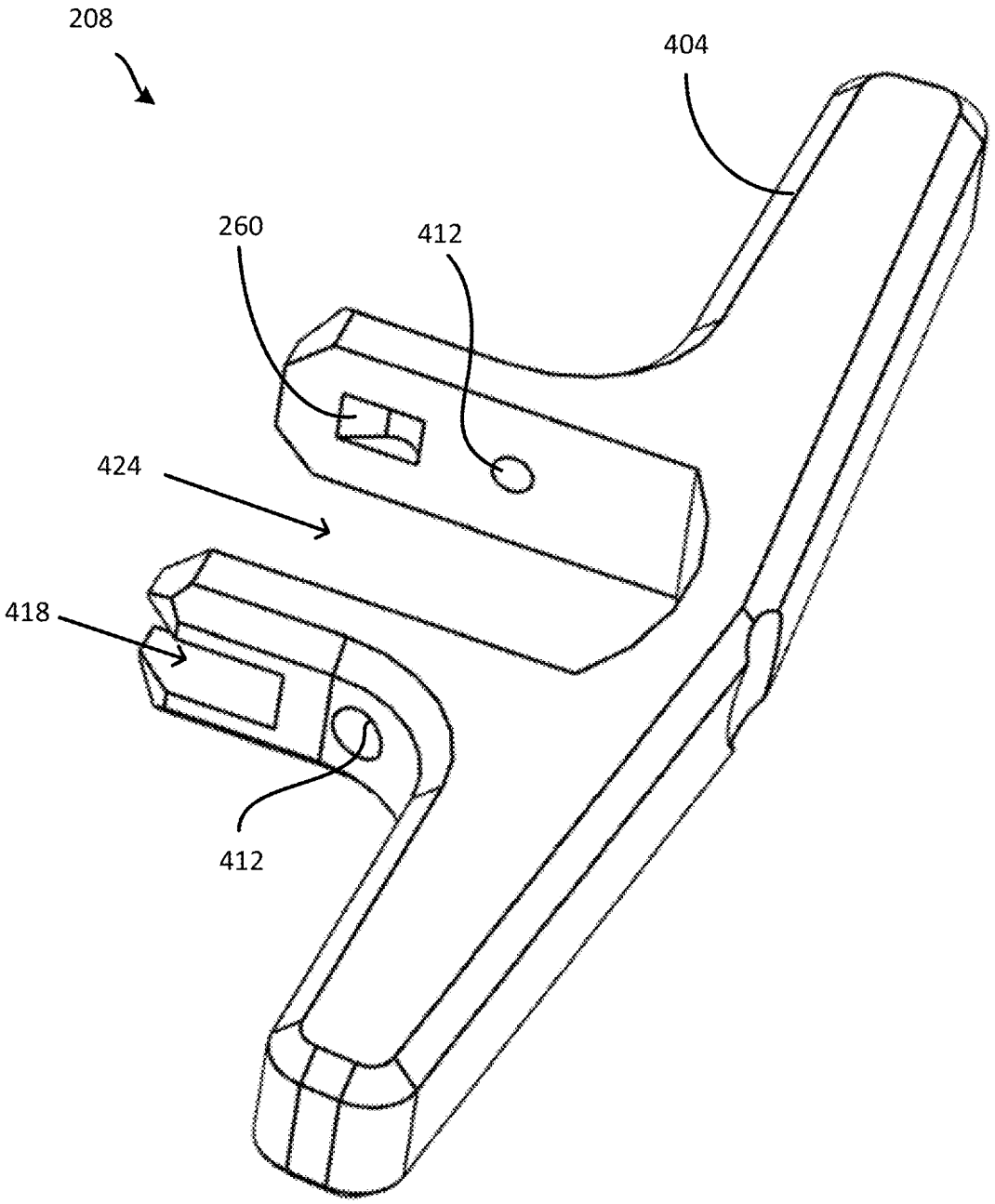
FIG. 12 is a top and rear perspective view of the handle of the charging handle assembly shown in FIG. 10, in accordance with an embodiment of the present disclosure.

FIG. 12 is a perspective view of the handle 208 configured to be used with an embodiment of the charging handle assembly 200 that includes a horizontal sliding latch 212, in accordance with an embodiment of the present disclosure. In one example, the handle 208 includes a grip 404, a body mounting slot 424, a latch mounting recess 418, a cam surface 260, and transverse bore 412. Some features of the handle 208 have been previously described and are not repeated below. The handle 208 is configured to receive the body 204 in the body mounting slot 424. In addition, the distal end of the handle includes a cam surface 260 which is configured to interact with the latch post 509. The interaction between the latch post 509 and the cam surface 260 depends upon the position of the handle 208 relative to the body 204. The interaction or the absence of interaction between the cam surface 260 and the latch post 509 facilitates latching or unlatching, as will be further described in more detail in FIGS. 14A and 14B.

In some examples, the cam surface 260 can be part of a semi-circular recess. In yet another example, the cam surface 260 can be configured to have a semi-elliptical cross-section. Regardless of its shape, the cam surface 260 includes a curved inner surface, which in some examples, can be either a smooth surface or a rough surface. In this one example, the cam surface is smooth. The curved and smooth cam surface 260 facilitates the actuation of the latch 212 between latched and unlatched positions. When a firearm user pulls the handle 208 rearward, the handle 208 moves rearward relative to the body 204. As a result, the cam surface 260 also moves rearward against a rounded free end of the latch post 509, which displaces the latch post 509 from the recess and pushes latch 212 laterally to an unlatched position. In other embodiments, the cam surface 260 is part of a protrusion on the handle 208.

Figure 13:
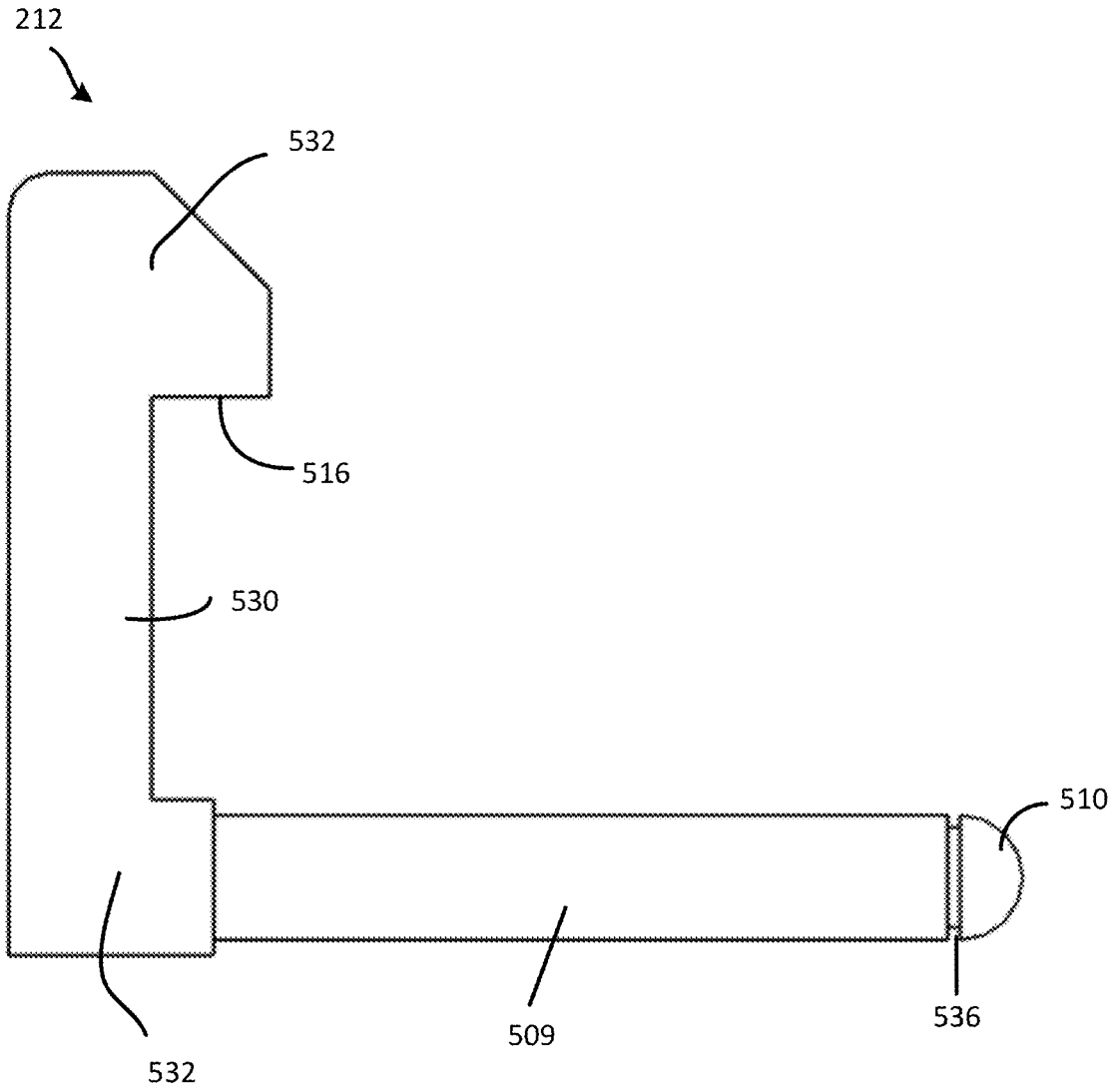
FIG. 13 is a top view of a latch of the charging handle assembly shown in FIG. 10, in accordance with embodiment of the present disclosure.

FIG. 13 is a top view of a latch 212 configured as a horizontal sliding latch 212, in accordance with an embodiment of the present disclosure. The latch 12, in one example embodiment, is "L" shaped, and includes a catch body 530 and a latch post 509. The catch body 530 includes a first end portion 532 and a second end portion 534. The first end portion 532 of the catch body 530 includes the catch surface 516. The latch post 509 connects to and extends transversely from the second end portion 534 of the catch body 530 to a free end 510. In some embodiments, the latch post 509 defines a groove or circumferential slot 536 adjacent the free end 510. The circumferential slot 536 is configured to retain the spring plate 215, which can be a circular retaining clip or the like. The latch post 509 is received through the crosswise opening 235 through the proximal end portion 246 of the body 204. The latch post 509 can take any cross-sectional shape, including a circle or rectangle. In this one example, the latch post 509 is a cylindrical and has a rounded free end 510. The rounded free end 510 facilitates sliding movement against the cam surface 260 for latching and unlatching.

Figure 14A:
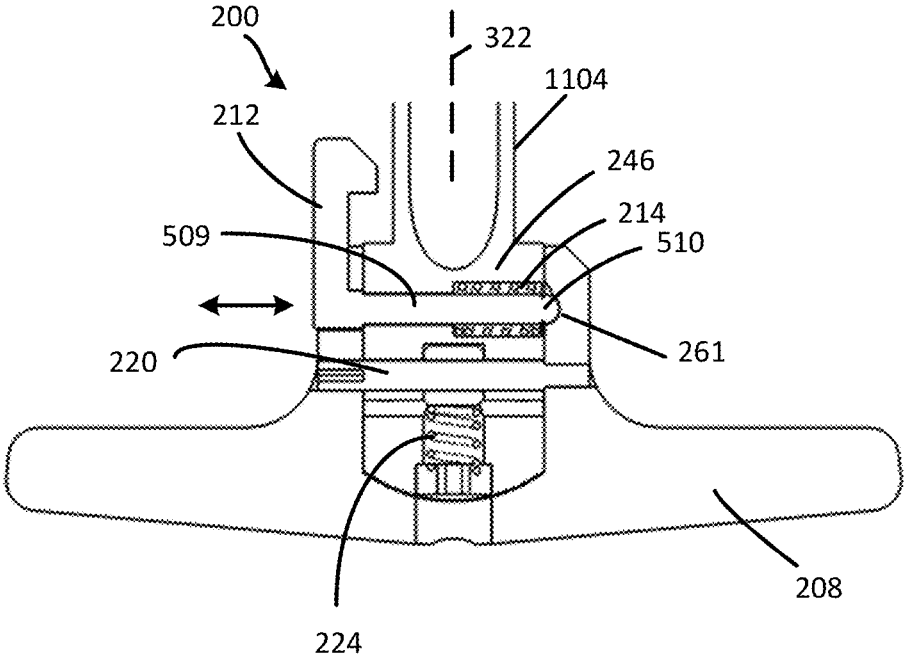
FIG. 14A is a top sectional view of the charging handle assembly of FIG. 10 showing the horizontal sliding latch in a latched position, in accordance with an embodiment of the present disclosure.
Figure 14B:
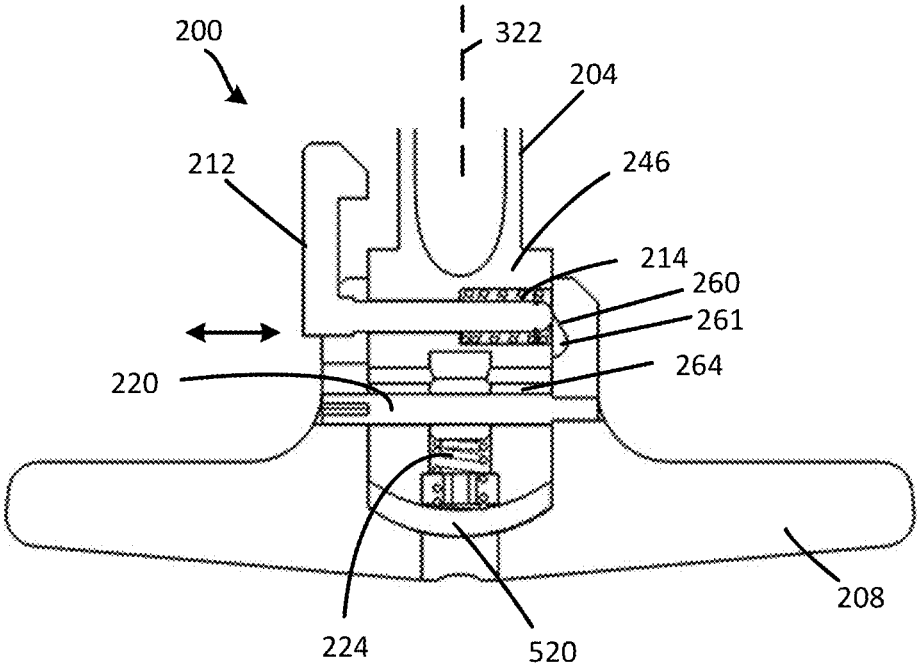
FIG. 14B is a top sectional view of the charging handle assembly of FIG. 10 showing the horizontal sliding latch in an unlatched position, in accordance with an embodiment of the present disclosure.

FIG. 14A is a top view of the charging handle assembly 200 with a horizontal sliding latch in a latched position, and FIG. 14B is a top view of the charging handle assembly 200 with the horizontal sliding latch 212 in an unlatched position, in accordance with an embodiment of the present disclosure. Horizontal movement of the latch 212 is in a direction perpendicular to the longitudinal axis 322 of the body 204, as indicated by a double-headed arrow in FIGS. 14A and 14B.

In the latched position, shown in FIG. 14A, the handle 208 is in contact with or otherwise seated against the proximal end portion 246 of the body 204, as evidence by the lack of a gap therebetween. The spring 224 between the handle 208 and body 204 extends to a more relaxed state. The cross pin 220 is positioned in a distal end of the elongated slot 264 and the rounded free end 510 of the latch post 509 is received in the recess 261 in the handle 208 with the latch spring 214 biasing the latch 212 towards the latched position. The catch body 530 extends generally along the body 204 (e.g., parallel to the longitudinal axis 322) for engagement with a recess 103 (shown in FIG. 1) or other such feature on the firearm receiver. To release the charging handle assembly 200 from the upper receiver 104, for example, the user pulls the handle 208 rearward, causing it to move rearward relative to the body 204, and in turn displace the latch 212 laterally to the unlatched position, such as shown in FIG. 14B.

In the unlatched position, shown in FIG. 14B, the handle 208 is axially spaced from the body 204 by the gap 520 therebetween. When the handle 208 is pulled rearward along the body 204, the cross pin 220 also moves axially within the elongated slot 264, compressing the spring 224. As the handle 208 moves rearward relative to the body 204, the free end 510 of the latch post 509 slides along the cam surface 260 of recess 261 and displaces the latch 212 laterally. When the user releases the handle 208, the spring 224 urges the handle 208 towards the seated position against the proximal end portion 246 of the body 204. In doing so, the latch post 509 returns to alignment with the recess 261, enabling the latch spring 214 to push the latch 212 laterally towards the latched position.

Charging Handle with Bottom Latch

Figure 15:
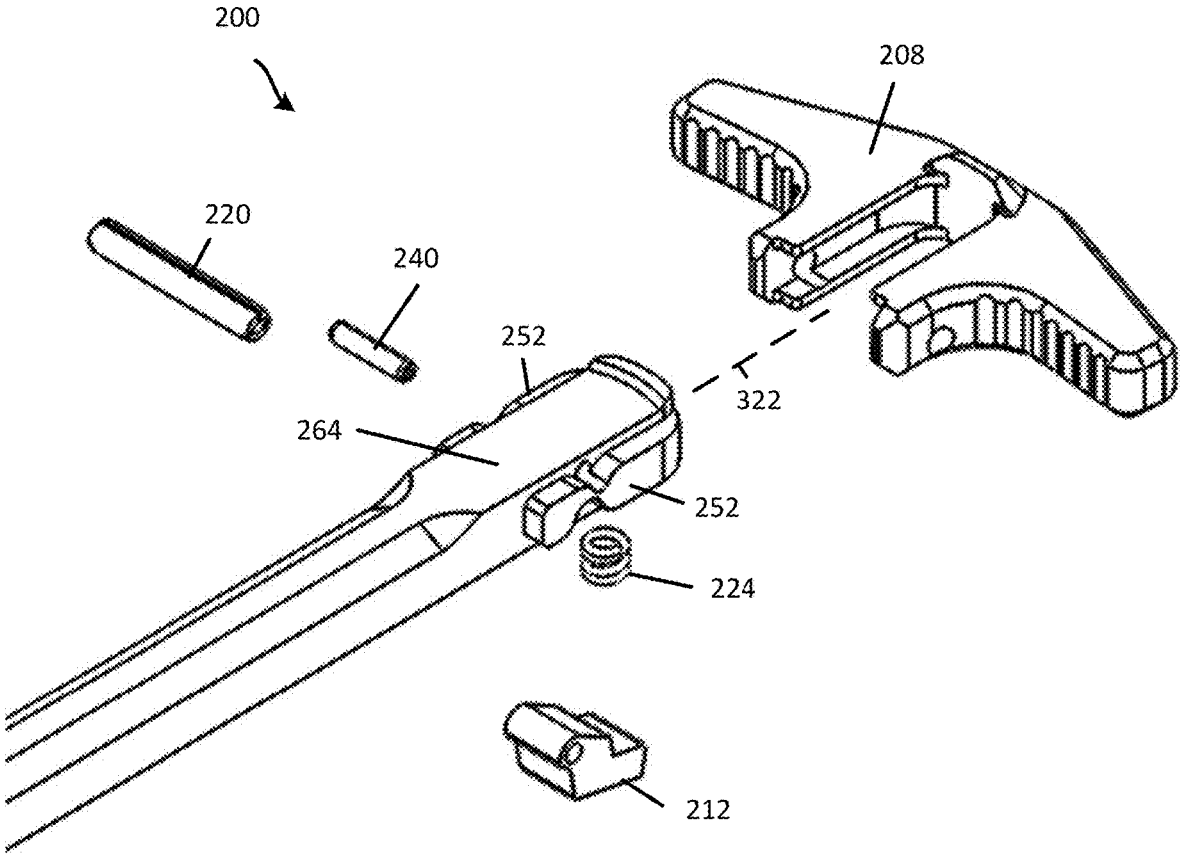
FIG. 15 is an exploded top and front perspective view of part of a charging handle assembly with a bottom latch, in accordance with an embodiment of the present disclosure.

FIG. 15 is an exploded, top and front perspective view of a charging handle assembly 200 with a bottom latch 212, in accordance with an embodiment of the present disclosure. In this example, the latch 212 is configured to engage with a latching surface on the top part of the firearm lower receiver 105, such as the uppermost ledge 111 or "shelf" of the lower receiver 105 (shown in FIG. 19A-19B). The uppermost ledge 111 of the lower receiver 105 is, in general, centrally located, broad, sturdy, and is ubiquitous to rifles of the AR-15 family (among others). Thus, the uppermost ledge 111 or other suitable surface on the lower receiver 105 allows for a charging handle with a bottom latch 212.

The charging handle assembly 200 with a bottom latch 212 is configured to include a single latch 212 biased downward to a latched position by a spring 224 so as to enable the latch to engage the lower receiver 105. In addition, the elongated slot 264 through the proximal end portion 246 of the body 204 is configured to receive a cross pin 220 so as to connect the body 204 and a handle 208 of the assembly 200. The cross pin 220 is configured to shift back and forth within the elongated slot 264 upon actuation of the handle 208. When a user pulls the handle 208 rearward, for example, the cross pin 220 shifts rearward within the elongated slot 264 and engages the latch 212, causing the latch to pivot upward to an unlatched position and disengaging the latch 212 from the corresponding surface of the lower receiver 105. When the handle 208 is released, the cross pin 220 shifts forward within the elongated slot 264 and allows the spring 224 to return the latch 212 downward to the latched position.

The charging handle assembly 200 with a bottom latch 212, like other embodiments discussed above, facilitates clearing the firearm chamber of any obstructions, charges the action, and other functions noted above. In this example embodiment, the charging handle assembly 200 includes a body 204 slidably attached to a handle 208, a latch 212 operable between a latched position and an unlatched position, a spring 224, a cross pin 220, and a latch pin 240. As some features of the body 204 and handle 208 have been previously described, they are not repeated below.

The body 204, in an example embodiment, can be configured to slidably receive the handle 208 so that movement of the handle 208 relative to the body 204 actuates the latch 212 to unlatch (or latch) the assembly 200 from (or onto) the lower receiver. In one example, the body 204 can be connected to the handle 208 with the cross pin 220 received within an elongated slot 264 at the proximal end portion 246 of the body 204. The elongated slot 264 enables the cross pin 220 to shift within the slot along the longitudinal axis 322 upon actuation of the handle 208, and thereby facilitates using the handle 208 to move the latch 212 to the unlatched position. The latch 212 is pivotably connected to the body by the latch pin 240, which extends crosswise to the longitudinal axis 322. Upon rearward movement of handle 208, the cross pin 220 shifts rearward within the slot 264 and contacts or otherwise applies pressure to the latch 212 to pivot the latch 212 upward to the unlatched position. In its assembled form in a firearm 100, moving the latch 212 to the unlatched position disengages the latch 212 from the lower receiver 105 and permits drawing the charging handle assembly 200 rearward. The latch 212 can be located in a cavity on the bottom side of the body 204. A spring 224 between the latch 212 and the body 204, such as extending generally vertically between a top of the latch 224 and an inside of the cavity in the body 204, biases the latch 212 towards the latched position.

Figure 16A:
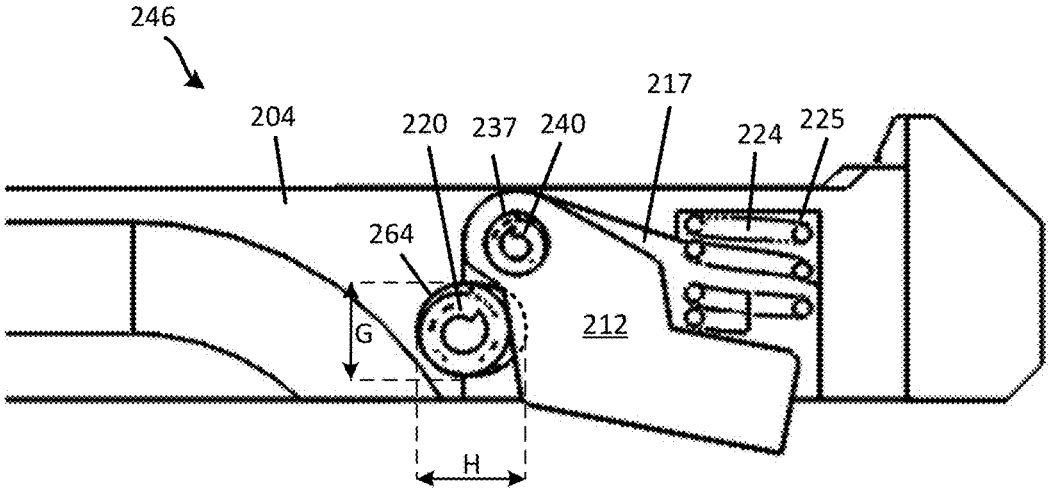
FIG. 16A is a side cross-sectional view of a proximal end portion of the body of the charging handle assembly shown in FIG. 15, in accordance with an embodiment of the present disclosure.
Figure 16B:
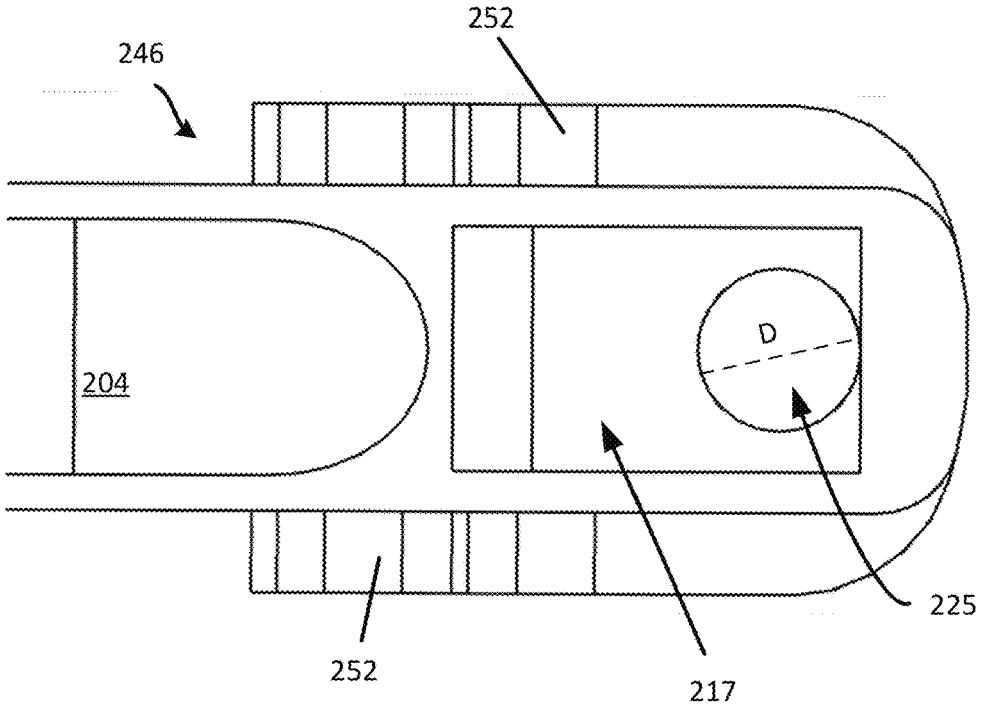
FIG. 16B is a bottom view of a proximal end portion of the body of the charging handle assembly shown in FIG. 15, in accordance with an embodiment of the present disclosure.

FIG. 16A is a side cross-sectional view showing a proximal end portion 246 of the body 204 and FIG. 16B is bottom view of a proximal end portion 246 of the body 204 of the charging handle assembly 200 of FIG. 15, in accordance with an embodiment of the present disclosure. The proximal end portion 246 of the body 204 supports the handle 208 and the latch 212. As with embodiments discussed above, the proximal end portion 246 defines an elongated slot 264 through which the cross pin 220 passes through and connects the body 204 and the handle 208. The proximal end portion 246 further defines a latch cavity 217 to receive the spring 224 and the latch 212. When a user pulls the handle 208 rearward, the cross pin 220 moves rearward within the elongated slot 264 and engages a distal face of the latch 212 to pivot the latch 212 upward. When the user releases the handle 208, the spring 224 urges the latch 212 downward and returns the cross pin 220 and handle 208 to a forward position. In the downward or latched position, the latch 212 is positioned to engage a catch surface (e.g., shelf 111) on the lower receiver 105.

In one example, sides of the proximal end portion 246 includes guides 252 to guide sliding movement of the handle 208 on the body 204. The guides 252 provide surfaces also to prevent misalignment of the handle 208 relative to the body 204 when the handle 208 moves backwards and forwards. As noted above, each guide 252 can be recessed below a top surface and/or above a bottom surface of the body 204. The body 204 can include a guide 252 on one or both sides of the proximal end portion 246.

The proximal end portion 246 further includes an elongated slot 264 configured to receive the cross pin 220 so as to movably connect the handle 208 to the body 204. The elongated slot 264, in particular, allows the cross pin 220 to linearly move forward and backward relative to the body 204. In one example, the elongated slot 264 is an elongated hole that passes laterally through the proximal end portion 246 and can include a minor axis or height and a major axis or length as indicated by "G" and "H", respectively, in FIG. 16A. The dimension of the elongated slot 264 can be of any size sufficient to receive the cross pin 220 and to allow movement of the cross pin 220 within the slot 264. In one example, dimension G has a nominal diameter of 0.128 inch and dimension H has a nominal size of 0.148 inch. Other dimensions are acceptable, as will be appreciated.

The proximal end portion 246 defines a pin opening 237 configured to receive the latch pin 240 so as to pivotably connect the latch 212 to the body 204. The dimension of the pin opening 237 can be of any size suitable to receive the latch pin 240. In one embodiment, the pin opening 237 intersects the guides 252 on sides of the proximal end portion 246.

The proximal end portion 246 further defines a latch cavity 217 to receive the latch 212 and the spring 224. The latch cavity 217 is defined in a bottom surface of the proximal end portion 246 and sized to receive the latch 212 and the spring 224. In this example, the latch cavity 217 is generally rectangular, and includes a length, a width, and a depth.

Optionally, a spring cavity 225 is defined within the latch cavity 217 and is configured to receive the spring 1624. The spring cavity 225 is defined in the bottom surface of the proximal end portion 246 and is sized to at least partially receive the spring 224. In this one example, the spring cavity 225 is circular and includes a nominal diameter of 0.200 inch. The spring 224 is at least partially disposed in the spring cavity 225 and extends between the spring cavity 225 and the latch 212 to bias the latch 212 to the latched position.

Figure 17:
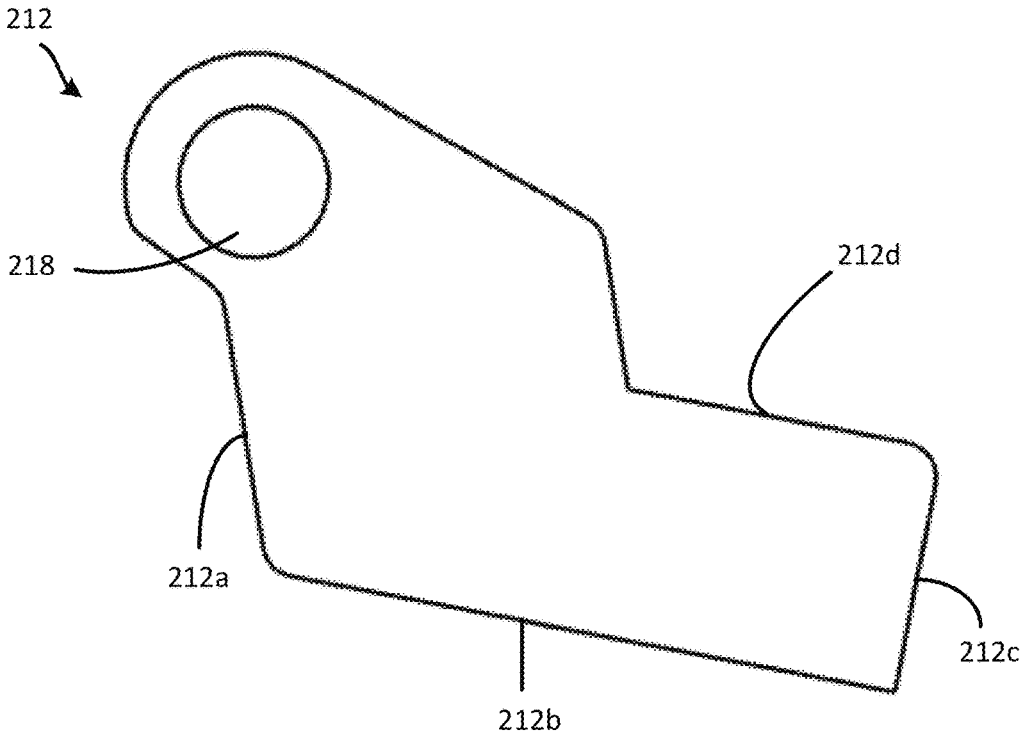
FIG. 17 is a side view of the latch of the charging handle assembly shown in FIG. 15 in accordance with an embodiment of the present disclosure.

FIG. 17 is a side view of the latch 212 of the charging handle assembly 200 shown in FIG. 15, in accordance with an embodiment of the present disclosure. The latch 212 is configured to be received within the latch cavity 217 of the body 204, so that the latch 212 can move up and down in response to the movement of the handle 208 relative to the body 204. The latch 212, in an example embodiment, include a latch pin opening 218 configured to receive the latch pin 240, a distal surface 212*a*, a bottom surface 212*b*, a proximal surface 212*c*, and a top surface 212*d*. The distal surface 212*a* is configured to interface with the cross pin 220 and may be inclined with respect to the horizontal, in accordance with some embodiments. The distal surface 212*a* meets the bottom surface 212*b* at an angle between 90°-180°, such as about 100-130°. The distal surface 212*a* is sized to be at least as large as the diameter of the cross pin 220, in some embodiments. The proximal surface 212*c* is configured to engage the lower receiver 105 when the latch 212 is in the latched position. The top surfaced 212*d* interfaces with the spring 224 so as to move the latch 212 up and down during the movement of the handle 208 relative to the body 204. In one example, the top surface 212*d* can be flat or curved and optionally defines a slot or recess to maintain contact with the spring 224.

Figure 18A:
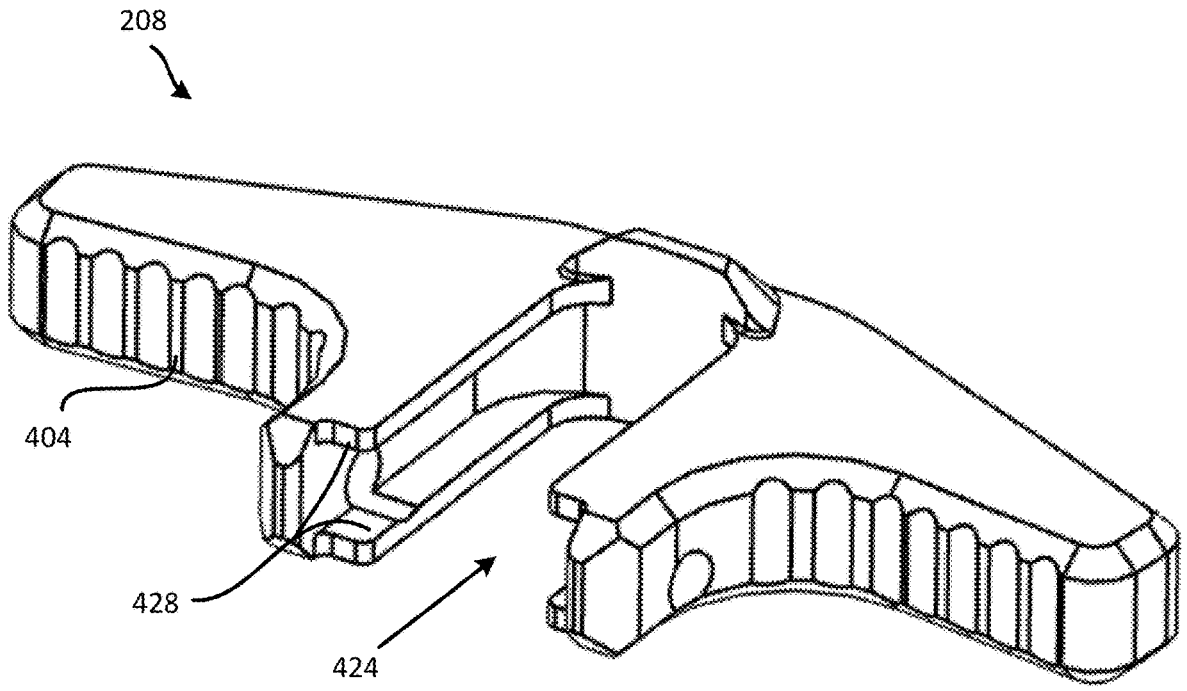
FIG. 18A is a top and front perspective view of the handle of the charging handle assembly shown in FIG. 15, in accordance with an embodiment of the present disclosure.
Figure 18B:
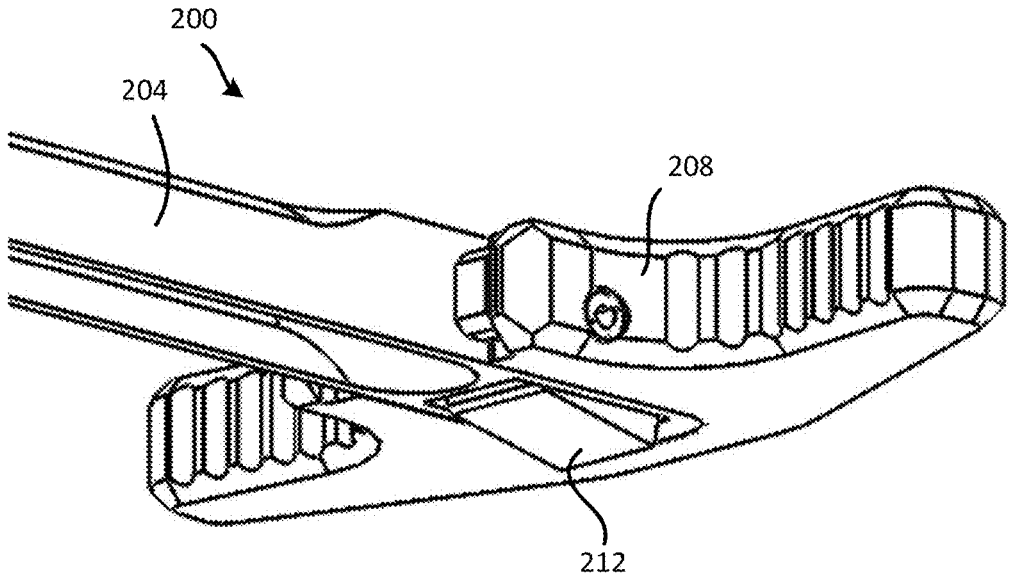
FIG. 18B is a bottom and front perspective view of the charging handle assembly of FIG. 15 showing the latch in a latched position, in accordance with an embodiment of the present disclosure.

FIG. 18A is a top and front perspective view of the handle 208 of the charging handle assembly 200 shown in FIG. 15, in accordance with an embodiment of the present disclosure. FIG. 18B is a bottom and front perspective view of the handle 208 and body 204, and shows the latch 212 in a latched position, in accordance with an embodiment of the present disclosure. The handle 208 allows the user to pull the charging handle assembly 200 rearward to ready the firearm 100 for the next firing cycle. In one example, the handle 208 includes a grip 404 and a body mounting slot 424 configured to slidably receive the proximal end portion 246 of the body 204, among other elements. As some features of handle 208 have already been described in relation to embodiments discussed above, they are not repeated below. The body mounting slot 424 is configured to slidably receive the body 204 such that the handle 208 can move relative to the body 204 to actuate the latch 212. In addition, the body mounting slot 424 can further include surfaces 428 that slide along and/or engage complimentary surfaces of the guides 252, such that the handle 208 and body 204 are in sliding contact with one another. As shown in FIG. 18B, portions of the latch 212 protrude below the bottom of the handle 208 and body 204 when the latch 212 is in the latched position so as to be positioned to engage the uppermost ledge 111 on the lower receiver 105. When the handle 208 is drawn rearwardly, the latch 212 pivots upward so that it is substantially flush with or recessed with respect to the bottom surface of the handle 208.

Figure 19A:
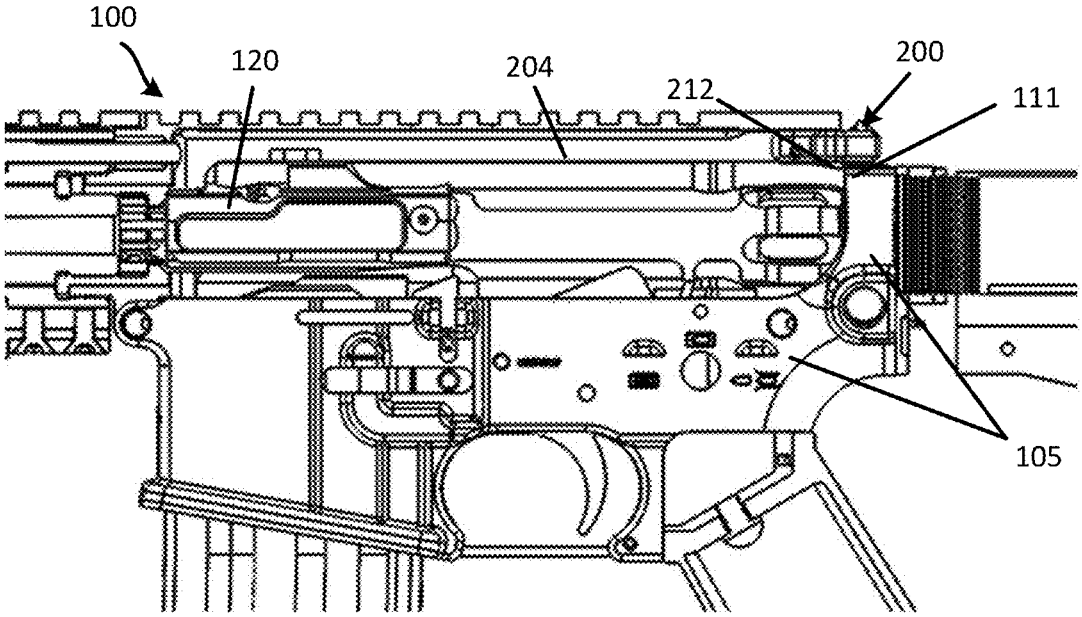
FIG. 19A is a side view of part of a firearm equipped with a charging handle assembly with bottom latch and showing the latch in a latched position, in accordance with an embodiment of the present disclosure.
Figure 19B:
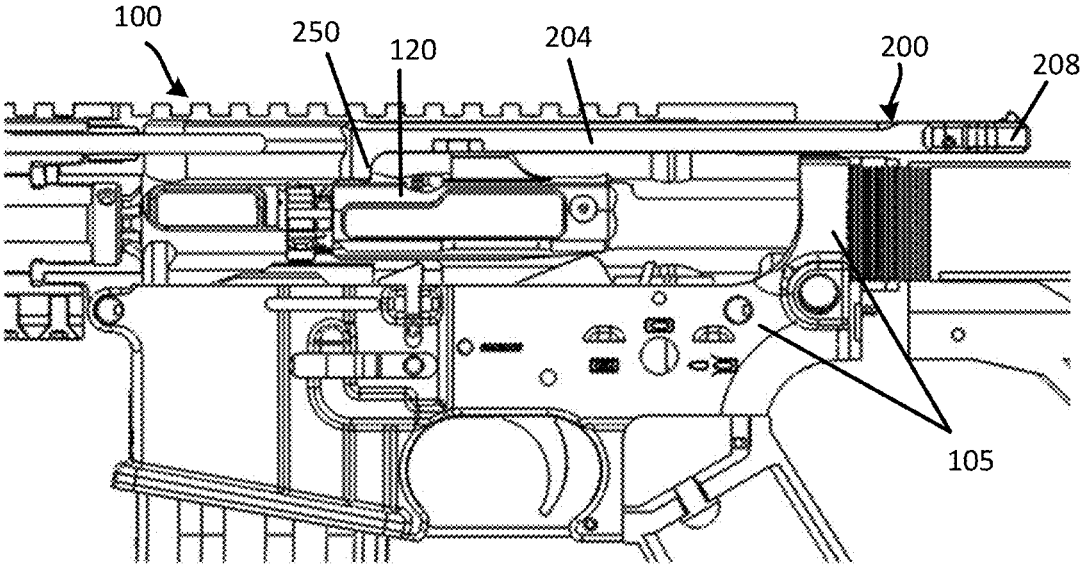
FIG. 19B is a cross-sectional view of the firearm of FIG. 19A showing the charging handle assembly drawn rearward in an unlatched position, in accordance with an embodiment of the present disclosure.

FIGS. 19A and 19B illustrate side views of part of a firearm 100 equipped with a charging handle assembly 200 with bottom latch 212, such as shown in FIGS. 15-18, in accordance with an embodiment of the present disclosure. In FIGS. 19A and 19B, portions of the firearm 100 are omitted to show engagement of the charging handle and bolt carrier within the upper receiver 104.

FIG. 19A shows the charging handle assembly 200 in latched position with the latch 212 engaging the uppermost shelf 111 of the lower receiver 105. As noted above, absent a rearward force on the handle 208, the spring 224 biases the latch 212 downward so that the proximal surface 212*c* of the latch 212 can engage with the shelf 111 of the lower receiver 105. To withdraw the charging handle assembly 200 rearward to charge the action, for example, the user can pull the handle 208 rearward, causing the handle 208 to move relative to the body 204, and in turn move the latch 212 to the unlatched position.

FIG. 19B shows the charging handle assembly 200 with the bottom latch 212 in unlatched position. Here, the charging handle assembly 200 engages the bolt carrier 120 and is drawn to a rearward position against the force of the recoil assembly applying a forward force on the bolt carrier 120, in accordance with an embodiment of the present disclosure. In the unlatched position, and while a rearward force is applied to the handle 208, the handle 208 is moved rearward with respect to the body 204, causing the cross pin 220 to engage the latch 212 (not visible) and pivot the latch 212 upward to the unlatched position. The latch 212 compresses the spring 224 allowing the latch 212 to be completely disposed within the latch cavity 217 in the proximal end portion 246 of the body 204. Upon the release of the handle 208 by the user from the position shown in FIG. 19B, the handle 208 will resume its latched position and the charging handle assembly 200 will be driven forward by the recoil assembly, returning the charging handle assembly 200 to the position of FIG. 19A where the latch 212 can engage the upper receiver 105.

FURTHER EXAMPLE EMBODIMENTS

The following examples pertain to further embodiments, from which numerous permutations and configurations will be apparent.

Example 1 is a charging handle assembly comprising a body extending along a longitudinal axis and having a proximal end portion and a distal end portion. A handle is attached to the proximal end portion of the body, where the handle is slidable along the proximal end portion between a first axial position and a second axial position. A spring is between the body and the handle, the spring biasing the handle to the first axial position. A latch is attached to the handle and operable between a latched position and an unlatched position, where moving the handle from the first axial position to the second axial position moves the latch from the latched position to the unlatched position.

Example 2 includes the subject matter of Example 1, where the proximal end portion defines a slot, and the assembly further comprises a pin extending between the handle and the body via the crosswise slot such that the pin secures the handle to the body.

Example 3 includes the subject matter of Example 2, where the slot extends crosswise through the body and the pin extends through the longitudinal slot.

Example 4 includes the subject matter of Example 2 or 3, where the slot has an elongated cross-sectional shape extending along the longitudinal axis.

Example 5 includes the subject matter of any of Examples 1-4, where the latch is pivotably attached to the handle.

Example 6 includes the subject matter of any of Examples 1-5, where the latch includes a latch body extending between a latch first end portion having a catch and a latch second end portion having a protrusion, the latch pivotable about the latch second end portion; and where the body includes a surface positioned to contact the protrusion on the latch end portion such that moving the handle from the first axial position to the second axial position pivots the latch from the latched position to the unlatched position.

Example 7 includes the subject matter of any of Examples 1-6, where the latch is a first latch on a first side of the body, the assembly further comprising a second latch on the second side of the body, the second latch generally mirroring the first latch.

Example 8 includes the subject matter of any of Examples 1-7, where the spring extends along the longitudinal axis.

Example 9 includes the subject matter of any of Examples 1-5, where the latch includes a latch body extending between a latch first end portion having a catch and a latch second end portion having a first protrusion and a second protrusion, the latch pivotable about the latch second end portion; where the body has a cam surface positioned to contact the first protrusion; where the spring is transverse to the longitudinal axis and applies a spring force to the second protrusion, the spring maintaining a substantially fixed axial position with respect to the body when the handle moves between the first axial position and the second axial position; and where moving the handle from the first axial position to the second axial position pivots the latch from the latched position to the unlatched position.

Example 10 includes the subject matter of Example 9, where the spring extends through a transverse bore in the body.

Example 11 includes the subject matter of Examples 9 or 10, where the latch is a first latch on a first side of the body, the charging handle assembly further comprising a second latch on the second side of the body, the second latch generally mirroring the first latch.

Example 12 includes the subject matter of any of Examples 9-11 and further comprises a plunger between the spring and the second protrusion.

Example 13 includes the subject matter of any of Examples 9-12, where moving the handle from the first axial position to the second axial position causes the second protrusion to move axially with respect to the spring and causes the first protrusion to contact the cam surface.

Example 14 includes the subject matter of any of Examples 9-13, where the cam surface is on a side of the body.

Example 15 is a charging handle assembly comprising a body extending along a longitudinal axis and having a proximal end portion and a distal end portion; a handle attached to the proximal end portion of the body, where the handle is configured to translate along the proximal end portion between a first axial position and a second axial position; a spring between the handle and the body, the spring biasing the handle toward the first axial position; and a latch attached to the body and operable between a latched position and an unlatched position, where moving the handle from the first axial position to the second axial position moves the latch from the latched position to the unlatched position.

Example 16 includes the subject matter of Example 15, where the proximal end portion of the body defines a slot elongated along the longitudinal axis, the assembly further comprising a pin extending between the handle and the body via the slot, the pin securing the handle to the body.

Example 17 includes the subject matter of Example 16, where the slot extends crosswise through the body and the pin extends through the slot.

Example 18 includes the subject matter of Examples 16 or 17, where the pin is part of a fastener.

Example 19 includes the subject matter of any of Examples 16-18, where the slot has a cross sectional shape selected from an oval, an ellipse, and a rectangle with rounded ends.

Example 20 includes the subject matter of any of Examples 15-19, where the latch is slidably attached to the body.

Example 21 includes the subject matter of any of Examples 15-20, where moving the handle between the first axial position and the second axial position translates the latch laterally with respect to the body.

Example 22 includes the subject matter of any of Examples 15-21, where the latch is L-shaped and includes a catch body with a first end portion including a catch surface and a second end portion; and a latch post extending transversely from the second end portion of the catch body to a free end, the latch post extending through a crosswise opening through the proximal end portion of the body; where the handle defines a cam surface configured to engage the free end of the latch post when the handle is moved from the first axial position to the second axial position.

Example 23 includes the subject matter of Example 22, where the catch body extends along a side the body generally parallel to the longitudinal axis.

Example 24 includes the subject matter of any of Examples 22-23 and further comprises a latch spring between the body and the latch, the latch spring biasing the latch laterally towards the latched position.

Example 25 includes the subject matter of Example 24, where the latch spring is at least partially contained within a spring bore that is coaxial with the crosswise opening.

Example 26 includes the subject matter of any of Examples 24-25, where the latch post further includes a spring plate adjacent the free end, and where the latch spring is between the spring plate and the body.

Example 27 includes the subject matter of any of Examples 22-26, where the free end is rounded.

Example 28 includes the subject matter of Example 16, where the free end is flat and defines an angle from 105-165 degrees to the longitudinal axis.

Example 29 includes the subject matter of Example 28, where the angle is from 120 to 150 degrees.

Example 30 includes the subject matter of Example 28, where the angle is from 130 to 140 degrees.

Example 31 includes the subject matter of any of Examples 22-30 where the cam surface is part of a recess in the handle.

Example 32 includes the subject matter of any of Examples 22-30, where the cam surface is adjacent a recess in the handle.

Example 33 includes the subject matter of Examples 31 or 32, where in the latched position the free end is received in the recess in the handle, and in the unlatched position the free end contacts the cam surface.

Example 34 includes the subject matter of any of Examples 15-19, where the latch is configured to pivot upward to the unlatched position and to pivot downward to the latched position.

Example 35 includes the subject matter of Example 34, where the handle includes a cam surface, the cam surface configured to contact the latch and pivot the latch to the unlatched position when the handle is moved to the second axial position.

Example 36 includes the subject matter of Examples 34 or 35 and further comprises a latch spring between the latch and the body, the latch spring biasing the latch downward toward the latched position.

Example 37 includes the subject matter of Example 36, where the spring generally extends vertically between the latch and the body.

Example 38 includes the subject matter of any of Examples 34-37, wherein the latch is on an underside of the body.

Example 39 includes the subject matter of any of Examples 34-38, and further comprises a firearm including an upper receiver and a lower receiver, where the body is configured to be slidably received in the upper receiver and the latch is configured to engage a top of the lower receiver in the latched position.

Example 40 includes the subject matter of Example 39, wherein the top of the lower receiver defines a recess or other catch surface.

Example 41 includes the subject matter of Example 39 or 40, wherein the latch engages an uppermost shelf of the lower receiver.

Example 42 is a charging handle assembly for a firearm, the assembly comprising a body extending along a longitudinal axis and having a proximal end portion and a distal end portion, the proximal end portion defining a slot crosswise therethrough, and the slot having an elongated cross-sectional shape. A handle is connected to the proximal end portion of the body, the handle translatable along the body between a first position and a second position. A cross pin extends through the slot and connects the body to the handle. A spring is disposed within the proximal end portion of the body, the spring biasing the handle toward the first position. A latch is connected to the handle or the body and is operable between a latched position and an unlatched position, where moving the handle from the first position to the second position moves the latch from the latched position to the unlatched position.

Example 43 includes the subject matter of Example 42, where the spring extends axially between the body and the cross pin.

Example 44 includes the subject matter of Examples 42 or 43, where the body further defines a crosswise bore through the proximal end portion, the spring extending through the crosswise bore and applying a spring force to the latch to bias the latch towards the latched position.

Example 45 includes the subject matter of any of Examples 42-44, where the latch includes a latch body extending between a latch first end portion having a catch and a latch second end portion having a protrusion, the latch laterally pivotable about the latch second end portion; and where a side of the body has a cam surface positioned to contact the protrusion when the handle moves to the second position and pivot the latch to the unlatched position.

Example 46 includes the subject matter of any of Examples 42-45, where the latch is a first latch on a first side of the body and the assembly further comprises a second latch on the second side of the body, the second latch substantially mirroring the first latch.

Example 47 includes the subject matter of any of Examples 42-44, where the latch is pivotably attached to the body, and where the latch is configured to pivot upward to the unlatched position and pivot downward to the latched position.

Example 48 includes the subject matter of Example 47, where the cross pin contacts the latch to pivot the latch to the unlatched position.

Example 49 includes the subject matter of any of Examples 1-48, where one or both sides of the proximal end portion of the body includes a rail, the handle sliding along the rail between the first position and the second position.

Example 50 includes the subject matter of any of Examples 1-49, where the handle defines a T-shape with the body.

Example 51 is a firearm comprising a lower receiver with a top portion; an upper receiver configured to be assembled with the lower receiver; and a charging handle assembly configured to be slidably received in the upper receiver, the charging handle assembly including an elongated body, a handle attached to the elongated body, and a latch operable between a latched position and an unlatched position, wherein in the latched position the latch is configured to engage the top portion of the lower receiver.

Example 52 includes the subject matter of Example 51, wherein the latch is on a bottom of the elongated body.

Example 53 includes the subject matter of Example 51 or 52, wherein the latch pivots upward to the unlatched position and pivots downward to the latched position.

Example 54 includes the subject matter of any of Examples 51-53, wherein the handle is slidably mounted to a proximal end portion of the body and is translatable along the proximal end portion between a first position and a second position, wherein translating the handle from the first position to the second position causes the latch to move from the latched position to the unlatched position.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A charging handle assembly comprising:

a body extending along a longitudinal axis and having a proximal end portion and a distal end portion, wherein the proximal end portion defines a crosswise through-opening having a cross-sectional shape that is elongated along the longitudinal axis;

a handle attached to the proximal end portion of the body, wherein the handle is slidable along the proximal end portion between a first axial position and a second axial position;

a spring between the body and the handle, the spring biasing the handle to the first axial position;

a first latch on a first side of the body, the first latch attached to the handle and operable between a latched position and an unlatched position, wherein moving the handle from the first axial position to the second axial position moves the first latch from the latched position to the unlatched position, wherein the first latch includes a latch body extending between a latch first end portion having a catch and a latch second end portion having a protrusion, the first latch pivotable about the latch second end portion;

a second latch on the second side of the body, the second latch generally mirroring the first latch; and a pin extending through the crosswise through-opening, wherein the pin moves with the handle when the handle moves between the first axial position and the second axial position wherein the body includes a surface positioned to contact the protrusion on the latch second end portion such that moving the handle from the first axial position to the second axial position pivots the first latch and/or the second latch from the latched position to the unlatched position.

2. The charging handle assembly of claim 1, wherein the spring extends along the longitudinal axis.

3. A charging handle assembly comprising:

a body extending along a longitudinal axis and having a proximal end portion and a distal end portion, wherein the proximal end portion defines a crosswise through-opening having a cross-sectional shape that is elongated along the longitudinal axis;

a handle attached to the proximal end portion of the body, wherein the handle is slidable along the proximal end portion between a first axial position and a second axial position;

a spring between the body and the handle, the spring biasing the handle to the first axial position;

a latch attached to the handle and operable between a latched position and an unlatched position, wherein moving the handle from the first axial position to the second axial position moves the latch from the latched position to the unlatched position; and a pin extending through the crosswise through-opening, wherein the pin moves with the handle when the handle moves between the first axial position and the second axial position;

wherein the latch includes a latch body extending between a latch first end portion having a catch and a latch second end portion having a first protrusion and a second protrusion, the latch pivotable about the latch second end portion;

wherein the body has a cam surface positioned to contact the first protrusion;

wherein the spring is transverse to the longitudinal axis and applies a spring force to the second protrusion; and wherein moving the handle from the first axial position to the second axial position pivots the latch from the latched position to the unlatched position.

4. The charging handle assembly of claim 3, wherein the latch is a first latch on a first side of the body, the charging handle assembly further comprising a second latch on the second side of the body, the second latch generally mirroring the first latch.

5. The charging handle assembly of claim 3, wherein moving the handle from the first axial position to the second axial position causes the second protrusion to move axially with respect to the spring and the first protrusion to contact the cam surface.

6. The charging handle assembly of claim 3, wherein the cam surface is on a side of the body.

7. A charging handle assembly comprising:

a body extending along a longitudinal axis and having a proximal end portion and a distal end portion, wherein the proximal end portion defines a crosswise through-opening extending laterally through the body and having a cross-sectional shape that is elongated along the longitudinal axis;

a handle attached to the proximal end portion of the body, wherein the handle is configured to translate along the proximal end portion between a first axial position and a second axial position and includes lateral portions extending laterally away from opposite lateral sides of the body;

a spring between the handle and the body, the spring biasing the handle toward the first axial position;

a latch attached to the body and operable between a latched position and an unlatched position, wherein moving the handle from the first axial position to the second axial position moves the latch from the latched position to the unlatched position; and a pin extending laterally through the crosswise through-opening between the lateral portions of the handle on opposite lateral sides of the body, wherein the pin secures the handle to the body and the pin moves axially with the handle when the handle moves between the first axial position and the second axial position.

8. The charging handle assembly of claim 7, wherein the latch is slidably attached to the body.

9. The charging handle assembly of claim 7, wherein moving the handle between the first axial position and the second axial position translates the latch laterally with respect to the body.

10. The charging handle assembly of claim 9, wherein the latch is L-shaped and includes a catch body with a first end portion including a catch surface and a second end portion;

a latch post extending transversely from the second end portion of the catch body to a free end, the latch post extending through a crosswise opening through the proximal end portion of the body; and wherein the handle defines a cam surface configured to engage the free end of the latch post when the handle is moved from the first axial position to the second axial position.

11. The charging handle assembly of claim 10 further comprising a latch spring between the body and the latch, the latch spring biasing the latch laterally towards the latched position.

12. The charging handle assembly of claim 11, wherein the cam surface is part of a recess in the handle proximal end portion of the body.

13. The charging handle assembly of claim 12, wherein in the latched position the free end is received in the recess in the handle proximal end portion of the body, and in the unlatched position the free end contacts the cam surface.

14. The charging handle assembly of claim 7, wherein the latch pivots upward to the unlatched position and pivots downward to the latched position.

15. The charging handle assembly of claim 14, wherein the latch is on an underside of the charging handle assembly.

16. The charging handle assembly of claim 15, wherein the handle includes a cam surface configured to contact the latch and pivot the latch to the unlatched position when the handle is moved to the second axial position.

17. The charging handle assembly of claim 14, wherein the proximal end portion of the body defines a slot extending crosswise therethrough, the slot having an elongated cross-sectional shape, wherein the assembly further comprises a cross pin extending between the handle and the body via the elongated slot, and wherein when moving the handle from the first axial position to the second axial position causes the pin is configured to contact the latch and pivot the latch upward to the unlatched position.

18. The apparatus of claim 14, further comprising a firearm including an upper receiver and a lower receiver, wherein the body is configured to be slidably received in the upper receiver and the latch is configured to engage a top of the lower receiver in the latched position.

19. A firearm comprising:

a lower receiver with a top portion;

an upper receiver configured to be assembled with the lower receiver; and a charging handle assembly comprising:

a body extending along a longitudinal axis and having a proximal end portion and a distal end portion;

a handle attached to the proximal end portion of the body, wherein the handle is slidable along the proximal end portion between a first axial position and a second axial position;

a spring between the body and the handle, the spring biasing the handle to the first axial position; and a latch attached to the handle and operable between a latched position and an unlatched position, wherein moving the handle from the first axial position to the second axial position moves the latch from the latched position to the unlatched position;

wherein the body is slidably received in the upper receiver, and wherein in the latched position the latch is configured to engage the top portion of the lower receiver.

20. The firearm of claim 19, wherein the latch is on a bottom of the body.

21. The firearm of claim 19, wherein the latch pivots upward to the unlatched position and pivots downward to the latched position.

* * * * *